US011024163B2

(12) United States Patent
Liu et al.

(10) Patent No.: US 11,024,163 B2
(45) Date of Patent: Jun. 1, 2021

(54) SYSTEMS AND METHODS FOR MONITORING TRAFFIC CONGESTION

(71) Applicant: BEIJING DIDI INFINITY TECHNOLOGY AND DEVELOPMENT CO., LTD., Beijing (CN)

(72) Inventors: Guoping Liu, Beijing (CN); Xiaocheng Cheng, Beijing (CN); Xin Kong, Beijing (CN)

(73) Assignee: BEIJING DIDI INFINITY TECHNOLOGY AND DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/751,174

(22) Filed: Jan. 23, 2020

(65) Prior Publication Data

US 2020/0160695 A1 May 21, 2020

Related U.S. Application Data

(63) Continuation of application No. PCT/CN2017/110644, filed on Nov. 13, 2017.

(51) Int. Cl.
*G08G 1/00* (2006.01)
*G08G 1/01* (2006.01)

(52) U.S. Cl.
CPC ..... *G08G 1/0133* (2013.01); *G08G 1/0129* (2013.01); *G08G 1/0141* (2013.01)

(58) Field of Classification Search
CPC .. G08G 1/0133; G08G 1/0129; G08G 1/0141; G08G 1/012
See application file for complete search history.

(56) References Cited

U.S. PATENT DOCUMENTS 9,418,544 B2 8/2016 Relyea et al.
2005/0027436 A1* 2/2005 Yoshikawa ..... G08G 1/096741 701/117

(Continued)

FOREIGN PATENT DOCUMENTS

CN 102968901 A 3/2013
CN 103578272 A 2/2014

(Continued)

OTHER PUBLICATIONS

International Search Report in PCT/CN2017/110644 dated Aug. 2, 2018, 4 pages.

(Continued)

*Primary Examiner* — Ojiako K Nwugo
(74) *Attorney, Agent, or Firm* — Metis IP LLC

(57) ABSTRACT

The present disclosure relates to systems and methods for monitoring traffic congestion. The systems may perform the methods to obtain traffic data associated with speeds or locations of a plurality of vehicles at a first time point; determine a plurality of congested links based on the traffic data; determine one or more congested areas by searching for congested links that are topologically close and clustering the congested links generated by the search; for each of the one or more congested areas, determine whether the congested area is a normal congested area or an abnormal congested area; and display congestion information associated with at least one of the one or more congested areas, wherein the congestion information may include a designation indicating whether the at least one of the one or more congested areas is the normal congested area or the abnormal congested area.

20 Claims, 11 Drawing Sheets

(56) References Cited

U.S. PATENT DOCUMENTS

| | | | | |
|---|---|---|---|---|
| 2005/0093720 | A1* | 5/2005 | Yamane | G08G 1/096827 340/995.13 |
| 2007/0208497 | A1* | 9/2007 | Downs | G08G 1/0104 701/117 |
| 2014/0149030 | A1* | 5/2014 | Chapman | G01C 21/3691 701/119 |
| 2016/0153804 | A1 | 6/2016 | Fowe | |
| 2016/0358468 | A1* | 12/2016 | McGavran | G01C 21/3492 |
| 2017/0345294 | A1* | 11/2017 | Hirotsu | G08G 1/08 |
| 2018/0061232 | A1* | 3/2018 | Madigan | G08G 1/0112 |

FOREIGN PATENT DOCUMENTS

| | | | |
|---|---|---|---|
| CN | 104157139 | A | 11/2014 |
| CN | 104240499 | A | 12/2014 |
| CN | 106781511 | A | 5/2017 |
| CN | 106887137 | A | 6/2017 |
| CN | 106960571 | A | 7/2017 |
| CN | 107123264 | A | 9/2017 |
| JP | 3473299 | B2 | 12/2003 |
| TW | M432106 | U | 6/2012 |

OTHER PUBLICATIONS

Written Opinion in PCT/CN2017/110644 dated Aug. 2, 2018, 4 pages.

Chengkun Liu et al., Exploring Time-dependent Traffic Congestion Patterns from Taxi Trajectory Data, Spatial Data Mining and Geographical Knowledge Services(ICSDM), pp. 39-44, 2015.

Lamiaa Fattouh Ibrahim et al., Applying Clustering Techniques in Hybrid Network Network in the Presence of 2D and 3D Obstacles, Computing and Informatics, 32(6): 1170-1191, 2014.

Kaisheng Zhang et al., Analyzing Spatiotemporal Congestion Pattern on Urban Roads base on Taxi GPS Data, Journal of Transport and Land Use, 10(1): 675-694, 2017.

Yan Zhuang et al. A Fast Clustering Approach for Identifying Traffic Congestions, 2010, 6 pages.

Kartika C., Visual Exploration of Spatial-Temporal Traffic Congestion Patterns Using Floating Car Data, 2015, 72 pages.

First Office Action in Chinese Application No. 201780071732.1 dated Mar. 24, 2021, 13 pages.

* cited by examiner

SYSTEMS AND METHODS FOR MONITORING TRAFFIC CONGESTION

CROSS-REFERENCE TO RELATED APPLICATIONS

This application is a continuation of International Application No. PCT/CN2017/110644, filed on Nov. 13, 2017, the contents of which are incorporated herein by reference in its entirety.

TECHNICAL FIELD

The present disclosure generally relates to methods and systems for traffic regulation, and more specifically, relates to systems and methods for monitoring traffic congestion.

BACKGROUND

Traffic congestion may include normal congestion and abnormal congestion. Normal congestion usually is caused by the increasing number of people and vehicles traveling within rush hours, which are largely predictable. Abnormal congestion may be caused by, for example, traffic accidents or bad weather, which are unpredictable. For normal congestion, traffic may free up in its own time. However, for abnormal congestion, traffic may improve faster with the help of a traffic control department. Therefore, it would be beneficial that the traffic control department could learn the abnormal congestion in time. In general, the traffic control department relies on experience to determine abnormal congestion, making traffic control inefficient and inaccurate. Therefore, it is desirable to provide systems and methods for monitoring congestion, and at least in part, for determining abnormal congestion efficiently and accurately.

SUMMARY

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

According to a first aspect of the present disclosure, a system is provided. The system may include at least one storage device storing a set of instructions; and at least one processor configured to communicate with the storage device. When executing the set of instructions, the at least one processor is configured to cause the system to perform the following operations. The at least one processor may obtain traffic data associated with speeds or locations of a plurality of vehicles at a first time point. The at least one processor may determine a plurality of congested links based on the traffic data. The at least one processor may determine one or more congested areas by searching for congested links that are topologically close and clustering the congested links generated by the search. The at least one processor may determine, for each of the one or more congested areas, whether the congested area is a normal congested area or an abnormal congested area. The at least one processor may display congestion information associated with at least one of the one or more congested areas, wherein the congestion information includes a designation indicating whether the at least one of the one or more congested areas is the normal congested area or the abnormal congested area.

In some embodiments, determining of the one or more congested area is conducted with a Density-Based Spatial Clustering of Applications with Noise (DBSCAN) algorithm and a Dijkstra algorithm.

In some embodiments, the at least one processor may initiate a first iteration process for determining the one or more congested areas. The first iteration process may include a plurality of iterations. Each iteration in the first iteration process may include selecting a congested link as a first target link from the plurality of congested links. Each iteration in the first iteration process may also include determining one or more first congested links from the plurality of congested links. A topologic distance between the first target link and each of the one or more first congested links may be less than a threshold distance. Each iteration in the first iteration process may also include adding the one or more first congested links to a cluster. Each iteration in the first iteration process may also include determining a congested area associated with the first target link based on the cluster. The at least one processor may determine the one or more congested areas based on the congested area determined in each iteration in the first iteration process.

In some embodiments, the at least one processor may initiate a second iteration process for determining the congested area associated with the first target link based on the cluster. The second iteration process may include a plurality of iterations. Each iteration in the second iteration process may include selecting a congested link as a second target link from the cluster. Each iteration in the second iteration process may also include determining one or more second congested links from the plurality of congested links. The topology distance between the second target link and each of the one or more second congested links may be less than the threshold distance. Each iteration in the second iteration process may also include adding the one or more second congested links to the cluster. The at least one processor may cluster the first target link and the congested links in the cluster as the congested area associated with the first target link.

In some embodiments, at least one of the plurality of iterations in the second iteration process may further include determining that all congested links in the cluster have been selected as the second target link. The at least one of the plurality of iterations in the second iteration process may further include terminating the second iteration process in response to the determination.

In some embodiments, at least one of the plurality of iterations in the second iteration process may further include determining that at least one congested link in the cluster has not been selected as the second target link. The at least one of the plurality of iterations in the second iteration process may further include initiating a new iteration of the second iteration process in response to the determination.

In some embodiments, at least one of the plurality of iterations in the first iteration process may further include determining that each of the plurality of congested links is included in the congested area determined in each iteration in the first iteration process. The at least one of the plurality of iterations in the second iteration process may further include terminating the first iteration process in response to the determination.

In some embodiments, at least one of the plurality of iterations in the first iteration process may further include determining that at least one of the plurality of congested links is not included in the congested area determined in each iteration in the first iteration process. The at least one of the plurality of iterations in the first iteration process may further include initiating a new iteration of the first iteration process in response to the determination.

In some embodiments, for each of the plurality of congested links, the at least one processor may obtain historical congestion data associated with the congested link. The at least one processor may determine a congestion probability of the congested link based on the historical congestion data. The at least one processor may determine whether the congestion probability is greater than a threshold probability. The at least one processor may determine the congested link as an abnormal congested link in response to a determination that the congestion probability is less than or equal to the threshold probability. For each of the one or more congested area, the at least one processor may determine whether a count of abnormal congested links in the congested area is greater than a threshold number.

The at least one processor may determine the congested area as the abnormal congested area in response to a determination that the count of abnormal congested links in the congested area is greater than the threshold number; or determine the congested area as the normal congested area in response to a determination that the count of abnormal congested links in the congested area is less than or equal to the threshold number.

In some embodiments, the at least one processor may obtain historical congestion information of at least one similar congested area prior to the first time point, wherein the at least one similar congested area is substantially similar to the at least one congested area of which the congestion information is being displayed. The at least one processor may compare the historical congestion information of the at least one similar congested area with the congestion information of the at least one congested area of which the congestion information is being displayed.

According to yet another aspect of the present disclosure, a method is provided. The method may be implemented on a computing device having one or more processors and one or more storage media. The method may include one or more of the following operations. The one or more processors may obtain traffic data associated with speeds or locations of a plurality of vehicles at a first time point. The one or more processors may determine a plurality of congested links based on the traffic data. The one or more processors may determine one or more congested areas by searching for congested links that are topologically close and clustering the congested links generated by the search. The one or more processors may determine, for each of the one or more congested areas, whether the congested area is a normal congested area or an abnormal congested area. The one or more processors may display congestion information associated with at least one of the one or more congested areas, wherein the congestion information includes a designation indicating whether the at least one of the one or more congested areas is the normal congested area or the abnormal congested area.

According to yet another aspect of the present disclosure, a system is provided. The system may include a traffic data obtaining module configured to obtain traffic data associated with speeds or locations of a plurality of vehicles at a first time point; a congested link determination module configured to determine a plurality of congested links based on the traffic data; a clustering module configured to determine one or more congested areas by searching for congested links that are topologically close and clustering the congested links generated by the search; an assigning module configured to determine, for each of the one or more congested areas, whether the congested area is a normal congested area or an abnormal congested area; and a displaying module configured to display congestion information associated with at least one of the one or more congested areas, wherein the congestion information includes a designation indicating whether the at least one of the one or more congested areas is the normal congested area or the abnormal congested area.

According to yet another aspect of the present disclosure, a non-transitory computer readable medium may include at least one set of instructions. The at least one set of instructions may be executed by one or more processors of a computing device. The one or more processors may obtain traffic data associated with speeds or locations of a plurality of vehicles at a first time point. The one or more processors may determine a plurality of congested links based on the traffic data. The one or more processors may determine one or more congested areas by searching for congested links that are topologically close and clustering the congested links generated by the search. The one or more processors may determine, for each of the one or more congested areas, whether the congested area is a normal congested area or an abnormal congested area. The one or more processors may display congestion information associated with at least one of the one or more congested areas, wherein the congestion information includes a designation indicating whether the at least one of the one or more congested areas is the normal congested area or the abnormal congested area.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
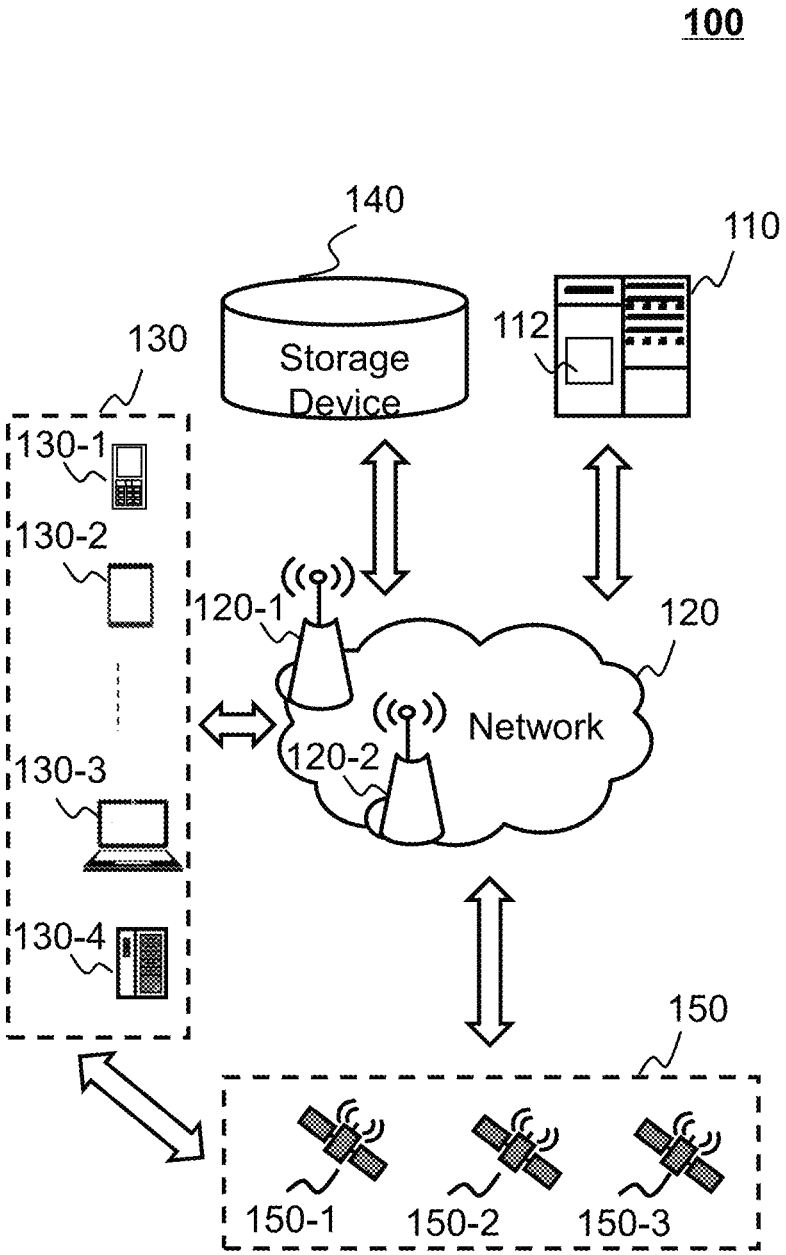
FIG. 1 is a schematic diagram illustrating an exemplary traffic congestion monitoring system according to some embodiments of the present disclosure.

The following description is presented to enable any person skilled in the art to make and use the present disclosure, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but is to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

The flowcharts used in the present disclosure illustrate operations that systems implement according to some embodiments of the present disclosure. It is to be expressly understood, the operations of the flowchart may be implemented not in order. Conversely, the operations may be implemented in inverted order, or simultaneously. Moreover, one or more other operations may be added to the flowcharts. One or more operations may be removed from the flowcharts.

Moreover, while the system and method in the present disclosure is described primarily regarding monitoring traffic congestion, it should also be understood that this is only one exemplary embodiment. The application scenarios of the system or method of the present disclosure may include a web page, a plug-in of a browser, a client terminal, a custom system, an internal analysis system, an artificial intelligence robot, or the like, or any combination thereof.

An aspect of the present disclosure relates to systems and methods for monitoring traffic congestion. According to the present of disclosure, a traffic congestion monitoring system may obtain real-time locations and real-time speeds of a plurality of vehicles. The traffic congestion monitoring system may determine a plurality of congested links on which vehicles are congested based on the real-time locations and the real-time speeds. The traffic congestion monitoring system may determine congested areas by searching for congested links that are topologically close and clustering the congested links generated by the search based on a Density-Based Spatial Clustering of Applications with Noise (DBSCAN) algorithm and a Dijkstra algorithm. The traffic congestion monitoring system may determine whether the congestion in a congested area is abnormal congestion that are hard to predict and do not happen regularly (e.g., caused by an accidental event such as a traffic accident). The traffic congestion monitoring system may display the congested area with the abnormal congestion. The traffic congestion monitoring system may also display when the abnormal congestion has started, when part of the abnormal congestion ended, how long the abnormal congestion lasted or would last, or where the abnormal congestion spreads.

FIG. 1 is a schematic diagram of an exemplary traffic congestion monitoring system 100 according to some embodiments. The traffic congestion monitoring system 100 may include a server 110, a network 120, a user terminal 130, a storage device 140, and a positioning system 150.

In some embodiments, the server 110 may be a single server or a server group. The server group may be centralized, or distributed (e.g., server 110 may be a distributed system). In some embodiments, the server 110 may be local or remote. For example, the server 110 may access information and/or data stored in the user terminal 130, and/or the storage device 140 via the network 120. As another example, the server 110 may be directly connected to the user terminal 130, and/or the storage device 140 to access stored information and/or data. In some embodiments, the server 110 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof. In some embodiments, the server 110 may be implemented on a computing device 200 having one or more components illustrated in FIG. 2 in the present disclosure.

In some embodiments, the server 110 may include a processing engine 112. The processing engine 112 may process information and/or data relating to traffic congestion monitoring to perform one or more functions described in the present disclosure. For example, the processing engine 112 may determine one or more congested areas by searching for congested links that are topologically close and clustering the congested links generated by the search. As another example, the processing engine 112 may determine whether a congested area is a normal congested area or an abnormal congested area. In some embodiments, the processing engine 112 may include one or more processing engines (e.g., single-core processing engine(s) or multi-core processor(s)). Merely by way of example, the processing engine 112 may include one or more hardware processors, such as a central processing unit (CPU), an application-specific integrated circuit (ASIC), an application-specific instruction-set processor (ASIP), a graphics processing unit (GPU), a physics processing unit (PPU), a digital signal processor (DSP), a field-programmable gate array (FPGA), a programmable logic device (PLD), a controller, a microcontroller unit, a reduced instruction-set computer (RISC), a microprocessor, or the like, or any combination thereof.

The network 120 may facilitate the exchange of information and/or data. In some embodiments, one or more components in the traffic congestion monitoring system 100 (e.g., the server 110, the user terminal 130, the storage device 140, and the positioning system 150) may send information and/or data to other component(s) in the congestion monitoring 100 via the network 120. For example, the server 110 may obtain traffic data from the user terminal 130 via the network 120. In some embodiments, the network 120 may be any type of wired or wireless network, or a combination thereof. Merely by way of example, the network 120 may include a cable network, a wireline network, an optical fiber network, a telecommunications network, an intranet, the Internet, a local area network (LAN), a wide area network (WAN), a wireless local area network (WLAN), a metropolitan area network (MAN), a wide area network (WAN), a public telephone switched network (PSTN), a Bluetooth™ network, a ZigBee network, a near field communication (NFC) network, or the like, or any combination thereof. In some embodiments, the network 120 may include one or more network access points. For example, the network 120 may include wired or wireless network access points such as base stations and/or internet exchange points 120-1, 120-2, . . . , through which one or more components of the traffic congestion monitoring system 100 may be connected to the network 120 to exchange data and/or information.

In some embodiments, the user terminal 130 may include a mobile device 140-1, a tablet computer 140-2, a laptop computer 140-3, or the like, or any combination thereof. In some embodiments, the mobile device 140-1 may include a smart home device, a wearable device, a mobile equipment, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a bracelet, footgear, glasses, a helmet, a watch, clothing, a backpack, a smart accessory, or the like, or any combination thereof. In some embodiments, the mobile equipment may include a mobile phone, a personal digital assistance (PDA), a gaming device, a navigation device, a point of sale (POS) device, a laptop, a desktop, or the like, or any combination thereof. In some embodiments, the virtual reality device and/or the augmented reality device may include a virtual reality helmet, a virtual reality glass, a virtual reality patch, an augmented reality helmet, augmented reality glasses, an augmented reality patch, or the like, or any combination thereof. For example, the virtual reality device and/or the augmented reality device may include a Google Glass™, a RiftCon™, a Fragments™, a Gear VR™, etc. In some embodiments, the user terminal 130 may be a device with positioning technology for locating the position of the user terminal 130. In some embodiments, the user terminal 130 may send positioning information to the server 110. For example, the user terminal 130 may obtain locations of a plurality of vehicles and send the locations to the server 110.

The storage device 140 may store data and/or instructions. In some embodiments, the storage device 140 may store data obtained from the user terminal 130 and/or the processing engine 112. For example, the storage device 140 may store traffic data obtained from the user terminal 130. In some embodiments, the storage device 140 may store data and/or instructions that the server 110 may execute or use to perform exemplary methods described in the present disclosure. For example, the storage device 140 may store data and/or instructions that the server 110 may execute or use to determine one or more congested areas. In some embodiments, the storage device 140 may include a mass storage, a removable storage, a volatile read-and-write memory, a read-only memory (ROM), or the like, or any combination thereof. Exemplary mass storage may include a magnetic disk, an optical disk, a solid-state drive, etc. Exemplary removable storage may include a flash drive, a floppy disk, an optical disk, a memory card, a zip disk, a magnetic tape, etc. Exemplary volatile read-and-write memory may include a random access memory (RAM). Exemplary RAM may include a dynamic RAM (DRAM), a double date rate synchronous dynamic RAM (DDR SDRAM), a static RAM (SRAM), a thyrisor RAM (T-RAM), and a zero-capacitor RAM (Z-RAM), etc. Exemplary ROM may include a mask ROM (MROM), a programmable ROM (PROM), an erasable programmable ROM (EPROM), an electrically-erasable programmable ROM (EEPROM), a compact disk ROM (CD-ROM), and a digital versatile disk ROM, etc. In some embodiments, the storage device 140 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage device 140 may be connected to the network 120 to communicate with one or more components in the traffic congestion monitoring system 100 (e.g., the server 110, the user terminal 130, etc.). One or more components in the traffic congestion monitoring system 100 may access the data or instructions stored in the storage device 140 via the network 120. In some embodiments, the storage device 140 may be directly connected to or communicate with one or more components in the traffic congestion monitoring system 100 (e.g., the server 110, the user terminal 130, etc.). In some embodiments, the storage device 140 may be part of the server 110.

The positioning system 150 may determine information associated with an object, for example, the user terminal 130. For example, the positioning system 150 may determine locations of the user terminal 130 in real-time. In some embodiments, the positioning system 150 may be a global positioning system (GPS), a global navigation satellite system (GLONASS), a compass navigation system (COMPASS), a BeiDou navigation satellite system, a Galileo positioning system, a quasi-zenith satellite system (QZSS), etc. The information may include a location, an elevation, a velocity, or an acceleration of the object, an accumulative mileage number, or a current time. The location may be in the form of coordinates, such as, latitude coordinate and longitude coordinate, etc. The positioning system 150 may include one or more satellites, for example, a satellite 150-1, a satellite 150-2, and a satellite 150-3. The satellites 150-1 through 150-3 may determine the information mentioned above independently or jointly. The satellite positioning system 150 may send the information mentioned above to the network 120, or the user terminal 130 via wireless connections.

Figure 2:
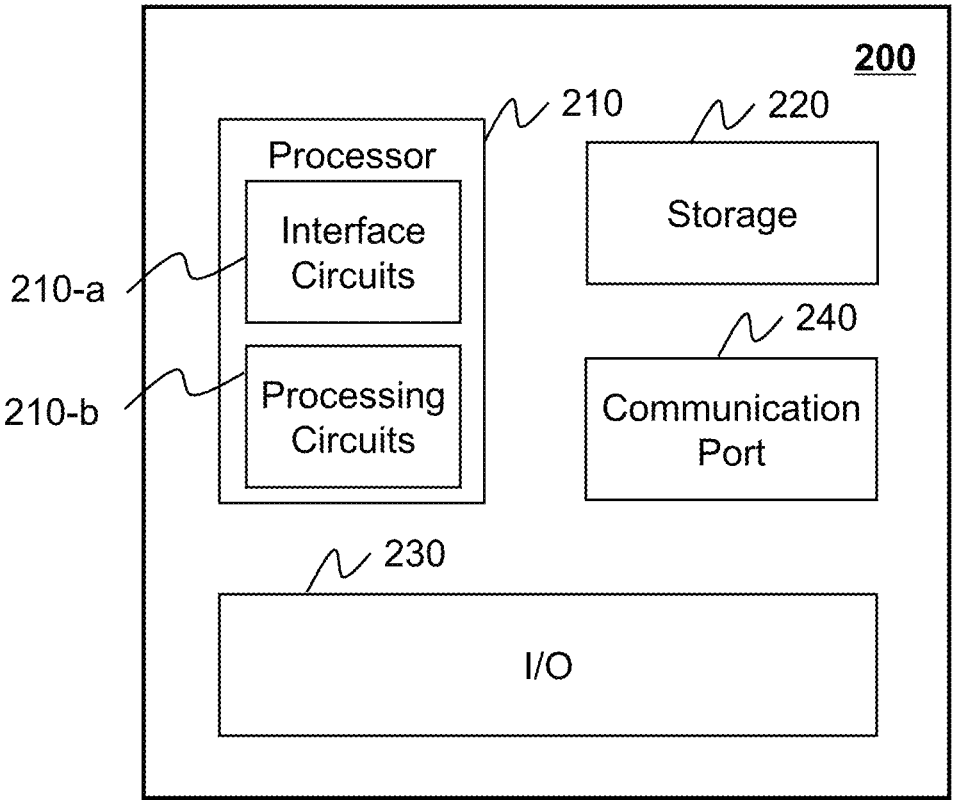
FIG. 2 is a schematic diagram illustrating exemplary hardware and/or software components of a computing device on which a processing engine may be implemented according to some embodiments of the present disclosure.

FIG. 2 is a schematic diagram illustrating exemplary hardware and/or software components of a computing device on which the processing engine 112 may be implemented according to some embodiments of the present disclosure. As illustrated in FIG. 2, the computing device 200 may include a processor 210, a storage 220, an input/output (I/O) 230, and a communication port 240.

The processor 210 (e.g., logic circuits) may execute computer instructions (e.g., program code) and perform functions of the processing engine 112 in accordance with techniques described herein. For example, the processor 210 may include interface circuits 210-*a* and processing circuits 210-*b* therein. The interface circuits may be configured to receive electronic signals from a bus (not shown in FIG. 2), wherein the electronic signals encode structured data and/or instructions for the processing circuits to process. The processing circuits may conduct logic calculations, and then determine a conclusion, a result, and/or an instruction encoded as electronic signals. Then the interface circuits may send out the electronic signals from the processing circuits via the bus.

The computer instructions may include, for example, routines, programs, objects, components, data structures, procedures, modules, and functions, which perform particular functions described herein. For example, the processor 210 may process traffic data obtained from the user terminal 130, the storage device 140, and/or any other component of the traffic congestion monitoring system 100. In some embodiments, the processor 210 may include one or more hardware processors, such as a microcontroller, a microprocessor, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an advanced RISC machine (ARM), a programmable logic device (PLD), any circuit or processor capable of executing one or more functions, or the like, or any combinations thereof.

Merely for illustration, only one processor is described in the computing device 200. However, it should be noted that the computing device 200 in the present disclosure may also include multiple processors, thus operations and/or method steps that are performed by one processor as described in the present disclosure may also be jointly or separately performed by the multiple processors. For example, if in the present disclosure the processor of the computing device 200 executes both step A and step B, it should be understood that step A and step B may also be performed by two or more different processors jointly or separately in the computing device 200 (e.g., a first processor executes step A and a second processor executes step B, or the first and second processors jointly execute steps A and B).

The storage 220 may store data/information obtained from the user terminal 130, the storage device 140, and/or any other component of the traffic congestion monitoring system 100. In some embodiments, the storage 220 may include a mass storage, a removable storage, a volatile read-and-write memory, a read-only memory (ROM), or the like, or any combination thereof. For example, the mass storage may include a magnetic disk, an optical disk, a solid-state drives, etc. The removable storage may include a flash drive, a floppy disk, an optical disk, a memory card, a zip disk, a magnetic tape, etc. The volatile read-and-write memory may include a random access memory (RAM). The RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. The ROM may include a mask ROM (MROM), a programmable ROM (PROM), an erasable programmable ROM (EPROM), an electrically erasable programmable ROM (EEPROM), a compact disk ROM (CD-ROM), and a digital versatile disk ROM, etc. In some embodiments, the storage 220 may store one or more programs and/or instructions to perform exemplary methods described in the present disclosure. For example, the storage 220 may store a program for the processing engine 112 for determining a congested link as a normal congested link or an abnormal congested link.

The I/O 230 may input and/or output signals, data, information, etc. In some embodiments, the I/O 230 may enable a user interact with the processing engine 112. In some embodiments, the I/O 230 may include an input device and an output device. Examples of the input device may include a keyboard, a mouse, a touch screen, a microphone, or the like, or a combination thereof. Examples of the output device may include a display device, a loudspeaker, a printer, a projector, or the like, or a combination thereof. Examples of the display device may include a liquid crystal display (LCD), a light-emitting diode (LED)-based display, a flat panel display, a curved screen, a television device, a cathode ray tube (CRT), a touch screen, or the like, or a combination thereof.

The communication port 240 may be connected to a network (e.g., the network 120) to facilitate data communications. The communication port 240 may establish connections between the processing engine 112 and the user terminal 130, the positioning system 150, or the storage device 140. The connection may be a wired connection, a wireless connection, any other communication connection that can enable data transmission and/or reception, and/or any combination of these connections. The wired connection may include, for example, an electrical cable, an optical cable, a telephone wire, or the like, or any combination thereof. The wireless connection may include, for example, a Bluetooth™ link, a Wi-Fi™ link, a WiMax™ link, a WLAN link, a ZigBee link, a mobile network link (e.g., 3G, 4G, 5G, etc.), or the like, or a combination thereof. In some embodiments, the communication port 240 may be and/or include a standardized communication port, such as RS232, RS485, etc.

Figure 3:
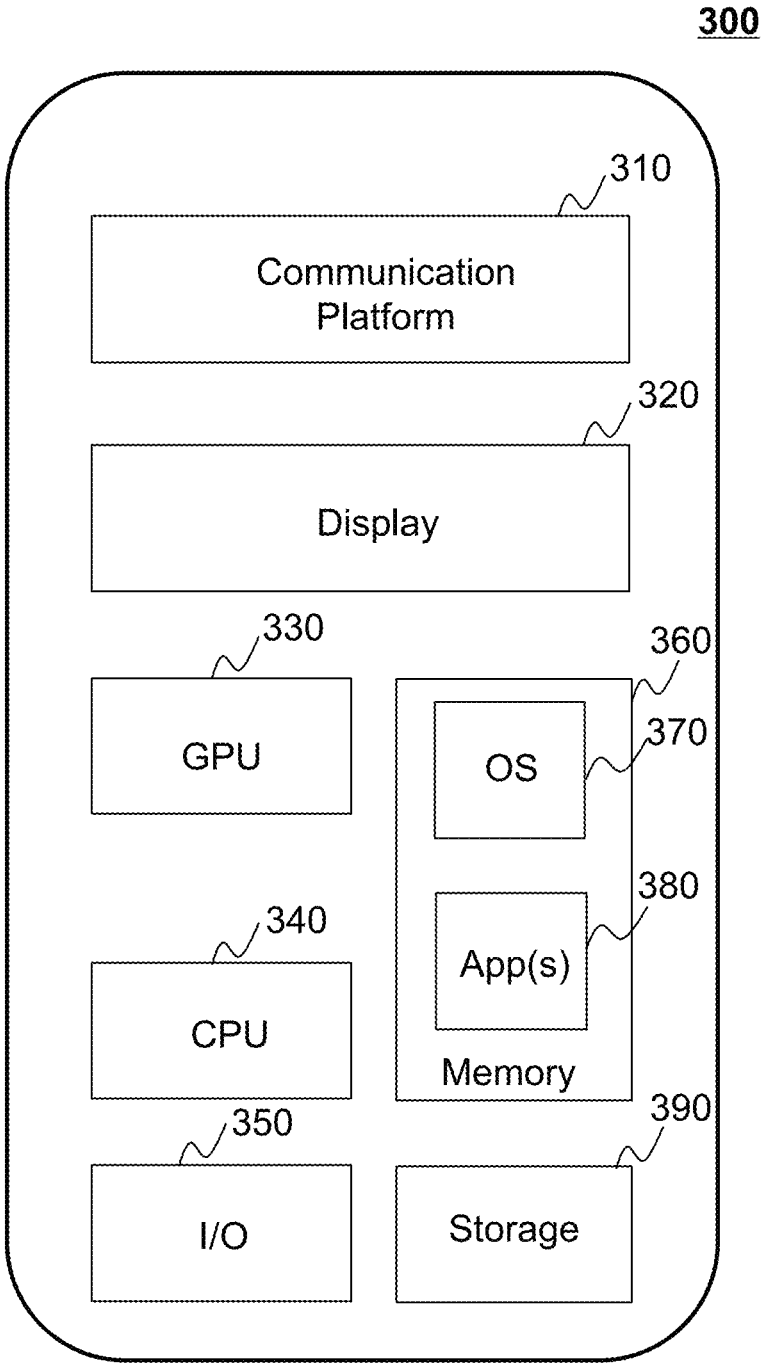
FIG. 3 is a schematic diagram illustrating exemplary hardware and/or software components of a mobile device on which one or more user terminals may be implemented according to some embodiments of the present disclosure.

FIG. 3 is a schematic diagram illustrating exemplary hardware and/or software components of a mobile device on which the user terminal 130 may be implemented according to some embodiments of the present disclosure. As illustrated in FIG. 3, the mobile device 300 may include a communication platform 310, a display 320, a graphic processing unit (GPU) 330, a central processing unit (CPU) 340, an I/O 350, a memory 360, and a storage 390. In some embodiments, any other suitable component, including but not limited to a system bus or a controller (not shown), may also be included in the mobile device 300. In some embodiments, a mobile operating system 370 (e.g., iOS™, Android™, Windows Phone™, etc.) and one or more applications 380 may be loaded into the memory 360 from the storage 390 in order to be executed by the CPU 340. User interactions with the information stream may be achieved via the I/O 350 and provided to the processing engine 112 and/or other components of the traffic congestion monitoring system 100 via the network 120.

To implement various modules, units, and their functionalities described in the present disclosure, computer hardware platforms may be used as the hardware platform(s) for one or more of the elements described herein. A computer with user interface elements may be used to implement a personal computer (PC) or any other type of work station or terminal device. A computer may also act as a server if appropriately programmed.

One of ordinary skill in the art would understand that when an element of the traffic congestion monitoring system 100 performs, the element may perform through electrical signals and/or electromagnetic signals. For example, when the processing engine 112 processes a task, such as making a determination, or displaying information, the processing engine 112 may operate logic circuits in its processor to process such task. When the processing engine 112 receives data (e.g., traffic data) from the user terminal 130, a processor of the processing engine 112 may receive electrical signals encoding the data through an input port. If the user terminal 130 communicates with the processing engine 112 via a wired network, the input port may be physically connected to a cable. If the user terminal 130 communicates with the processing engine 112 via a wireless network, the input port of the processing engine 112 may be one or more antennas, which may convert the electrical signals to electromagnetic signals. Within an electronic device, such as the user terminal 130, and/or the server 110, when a processor thereof processes an instruction, sends out an instruction, and/or performs an action, the instruction and/or action is conducted via electrical signals. For example, when the processor retrieves or saves data from a storage medium (e.g., the storage device 140), it may send out electrical signals to a read/write device of the storage medium, which may read or write structured data in the storage medium. The structured data may be transmitted to the processor in the form of electrical signals via a bus of the electronic device. Here, an electrical signal may refer to one electrical signal, a series of electrical signals, and/or a plurality of discrete electrical signals.

Figure 4:
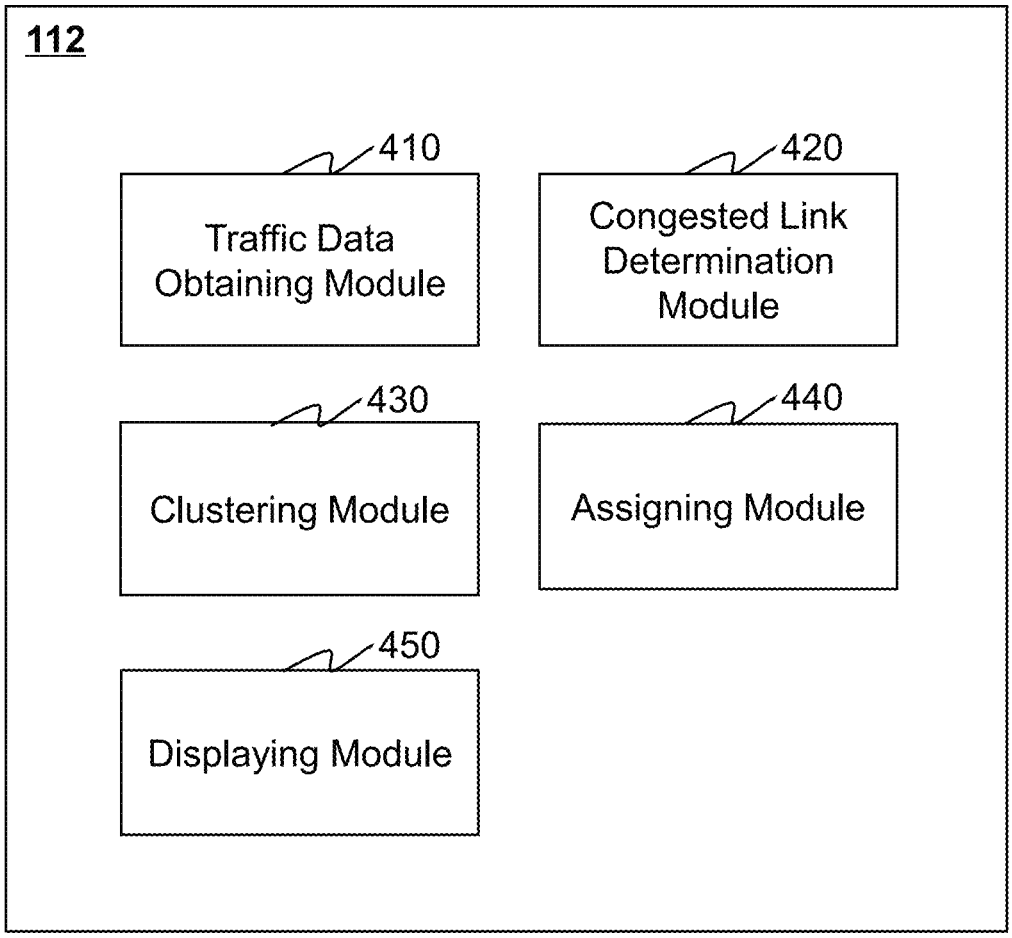
FIG. 4 is a schematic block diagram illustrating an exemplary processing engine according to some embodiments of the present disclosure.

FIG. 4 is a schematic block diagram illustrating an exemplary processing engine according to some embodiments of the present disclosure. The processing engine 112 may include a traffic data obtaining module 410, a congested link determination module 420, a clustering module 430, an assigning module 440, and a displaying module 450.

The traffic data obtaining module 410 may be configured to obtain traffic data corresponding to a first time point (e.g., a current time). The traffic data may associate with a plurality of vehicles of users of the traffic congestion monitoring system 100 in a certain region (e.g., Beijing). The traffic data of a vehicle may include a speed of the vehicle, a location of the vehicle, an identification of the vehicle, or the like, or any combination thereof. The vehicle may include a horse, a carriage, a rickshaw (e.g., a wheelbarrow, a bike, a tricycle, etc.), an electromobile (e.g., an electric bike, an electric tricycle, etc.), a car (e.g., a taxi, a bus, a private car, etc.), a train, a subway, a vessel, an aircraft (e.g., an airplane, a helicopter, a space shuttle, a rocket, a hot-air balloon, etc.), or the like, or any combination thereof.

In some embodiments, a terminal (e.g., the user terminal 130) of a user may establish a communication (e.g., a wireless communication) with the processing engine 112, via an application installed in the terminal. In some embodiments, the application may relate to the traffic congestion monitoring system 100. The terminal may obtain the traffic data from and/or send the traffic data to the processing engine 112 through the application.

In some embodiments, the user terminal 130 of a user may determine the speed of a vehicle associated with the user by a speed sensor mounted in the user terminal 130. For example, when a driver is driving a vehicle, the driver's smart phone may determine the speed of the vehicle by a speed sensor mounted in the smart phone. In some embodiments, the user terminal 130 may determine the speed of the vehicle by periodically (e.g. every 1, 2, 5, 10, 20, or 30 seconds) monitoring the location of the vehicle, calculating a road distance between the locations, and calculating the speed by taking into consideration the time passed between various location changes.

In some embodiments, the user terminal 130 of the user may determine the location of the vehicle by a positioning technique in the user terminal 130. The position technique may include a GPS (global positioning system), a GLONASS (global navigation satellite system), a COMPASS (compass navigation system), a Galileo positioning system, a QZSS (quasi-zenith satellite system), a Wi-Fi (wireless fidelity positioning technology, various positioning and speed measuring systems that a vehicle has, or the like, or any combination thereof.

In some embodiments, the application installed in the user terminal 130 may direct the user terminal 130 to constantly send the real-time location of the vehicle and the real-time speed of the vehicle to the processing engine 112. Consequently, the processing engine 112 may receive the location of the vehicle and the speed of the vehicle in real-time or substantially real-time.

The identification of the vehicle may include a plate number, a vehicle identification number (VIN), or the like, or any combination thereof. In some embodiments, the user may input the identification of the vehicle through the interface of the application. In some embodiment, the user terminal 130 may automatically determine the identification of the vehicle. For example, a driver may register an account of the application when the driver first uses the application. The driver may input an identification of a vehicle and tie the vehicle to the application. When the user terminal 130 sends the speed and the location of the vehicle to the processing engine 112 through the application that is tied to the vehicle, the user terminal 130 may also send the identification of the vehicle to the processing engine 112. As another example, a passenger may request an order of a taxi service through the application. During the travel of the taxi service, the user terminal 130 of the passenger may determine the speed and the location of a vehicle of a driver that accepts the order and send the speed and the location of the vehicle along with the identification of the vehicle to the processing engine 112.

In some embodiments, the traffic data may further include road information. The road information may include traffic accident information, road maintenance information, event information (e.g., a concert), or the like, or any combination thereof. A user may input the road information through an interface of the application installed in the user terminal 130 and send the road information to the processing engine 112. For example, a user may input the road information that an accident happens in No. 3 Haidian Avenue and send the road information to the processing engine 112.

The congested link determination module 420 may be configured to determine a plurality of congested links based on the traffic data. A link refers to a segment of a road facing a particular direction in normal traffic. In some embodiments, a road network of a certain region (e.g., Beijing) may include a plurality of links. In some embodiments, for a link, the congested link determination module 420 may determine the area of the link. In certain embodiments, the area of a link refers to specific lateral area, e.g., 1200 square meters. In certain embodiments, the area of a link refers to vehicle accommodating area, e.g., 3 vehicle lanes, 300 meters long, not specific lateral area. The congested link determination module 420 may determine the total number of vehicles on the link based on the traffic data corresponding to the first time point. The congested link determination module 420 may determine a traffic density on the link based on the area of the link and the total number of vehicles on the link. The congested link determination module 420 may determine the number of vehicles of which the speed is lower than a first threshold (e.g., 5 km/h) based on the traffic data corresponding to the first time point. The congested link determination module 420 may determine whether the traffic density on the link is greater than a second threshold (e.g., 12 square meters per vehicle, or 5 meters per lane per vehicle) and whether the proportion of the number of vehicles of which the speed is lower than the first threshold in the total number of vehicles on the link is greater than a third threshold (e.g., 90%). The congested link determination module 420 may determine the link as a congested link in response to a determination that the traffic density on the link is greater than the second threshold and the proportion is greater than the third threshold.

The clustering module 430 may be configured to determine one or more congested areas by searching for congested links that are topologically close and clustering the congested links generated by the search. The congested area may include one or more roads, one or more intersections, or the like, or any combination thereof. For example, the congested area may include Zhongguancun Street, Beijing, and the intersection of Zhongguancun Street, Beijing and North Fourth Ring Road West, Beijing.

In some embodiments, to be considered topologically close, two congested links may have a topologic distance that is less than a fourth threshold. In some embodiments, the topologic distance between two links refers to the length of a route between the two links. Therefore, in certain embodiments, two links that are geographically close (e.g., two neighboring highway segments in reverse directions) may not be topologically close. In some embodiments, if there are more than one route between the two links, the clustering module 430 may select a route length that is shortest among the lengths of the more than one route as the topologic distance between the two links. In certain embodiments, the clustering module 430 may select a route length that corresponds to a route that takes the shortest time in normal traffic conditions as the topologic distance between the two links. In some embodiments, the clustering module 430 may determine the one or more congested areas based on a Density-Based Spatial Clustering of Applications with Noise (DBSCAN) algorithm and a Dijkstra algorithm (e.g., as described elsewhere in this disclosure in connection with FIG. 6).

The assigning module 440 may be configured to determine whether a congested area is a normal congested area or an abnormal congested area. Traffic congestion may include normal congestion and abnormal congestion. Normal congestion refers to congestions that are easy to predict and happen regularly. For example, a normal congestion may be caused by the increasing number of people and vehicles traveling within rush hours, which may be predictable and regular. Abnormal congestion refers to congestions that are hard to predict and do not happen regularly. For example, an abnormal congestion may be caused by an accidental event such as a traffic accident or vehicle breakdown. The normal congested area refers to a congested area having normal congestion. The abnormal congested area refers to a congested area having abnormal congestion.

Figure 7:
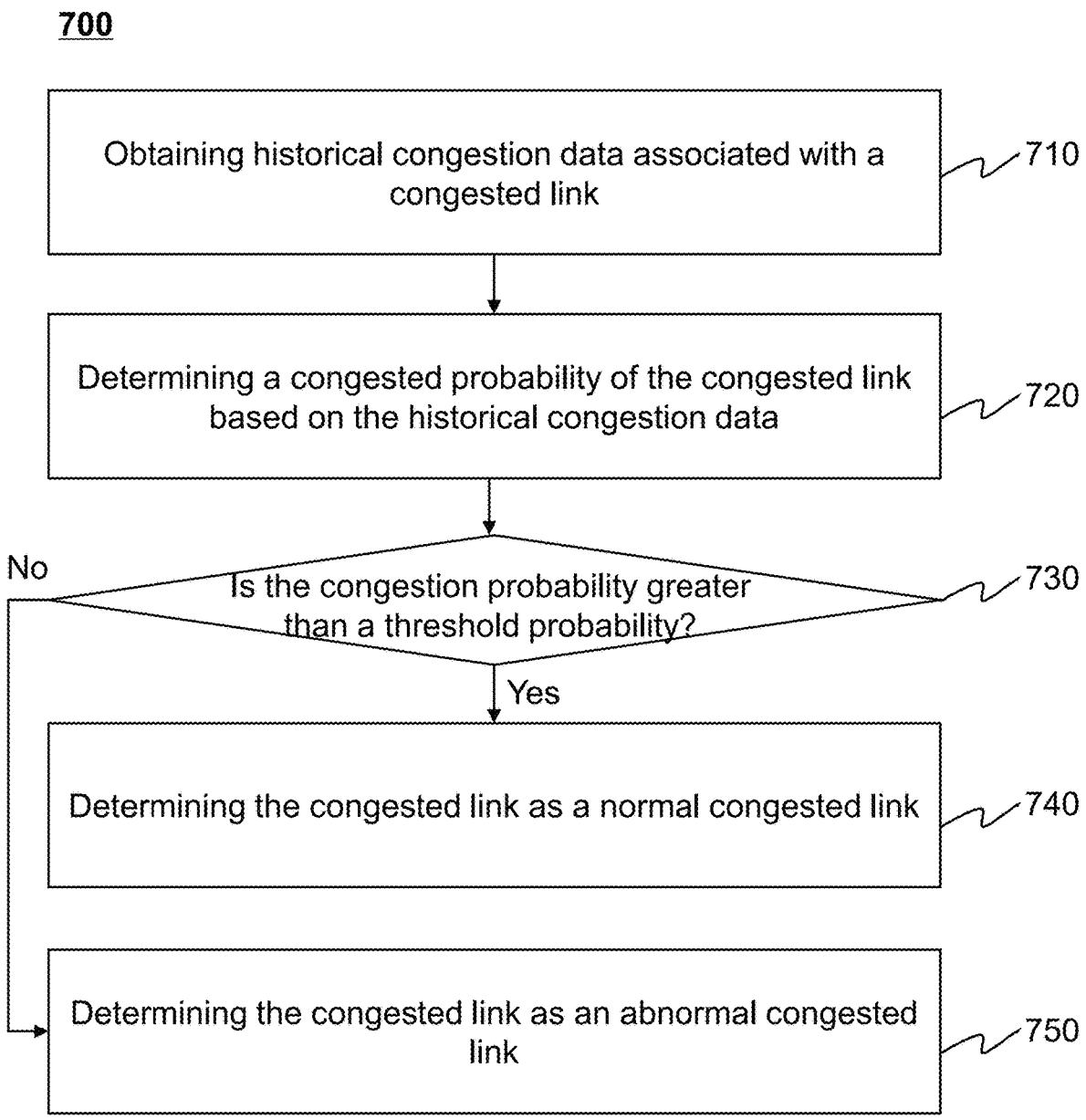
FIG. 7 is a flowchart illustrating an exemplary process for determining an abnormal congested link according to some embodiments of the present disclosure.
Figure 8:
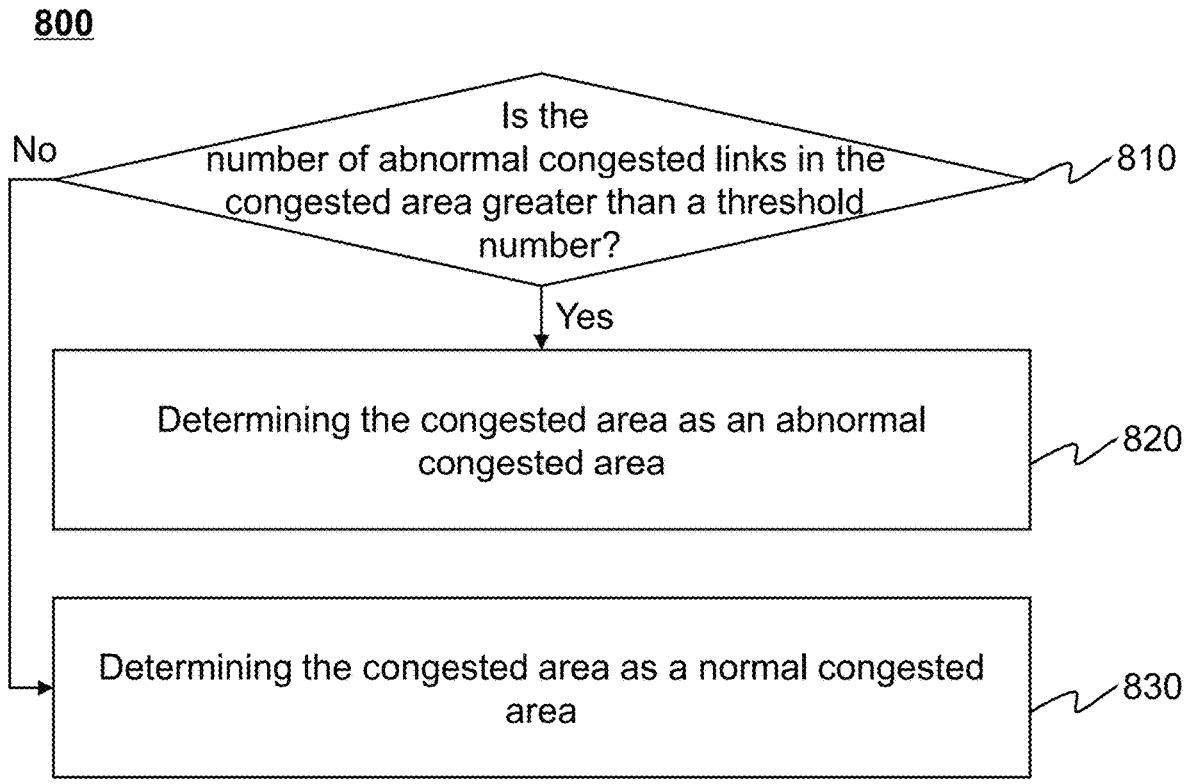
FIG. 8 is a flowchart illustrating an exemplary process for determining an abnormal congested area according to some embodiments of the present disclosure.

In some embodiments, the assigning module 440 may determine whether a congested area is a normal congested area or an abnormal congested area based on historical congestion data associated with the plurality of congested links (e.g., as described elsewhere in this disclosure in connection with FIGS. 7 and 8). The historical congestion data associated with a congested link corresponding to the first time point may include the number of times that the congested link was determined as a congested link at one or more corresponding time points in a time period prior to the first time point. The one or more corresponding time points may correspond to the first time point in terms of a predetermined categorization (e.g. weekday or weekend). For example, the historical congestion data associated with a congested link corresponding to 8:00 am (e.g., the current time) may include the number of times that the congested link was determined as a congested link corresponding to 8:00 am every weekday in a time period (e.g., the past 30 weekdays).

In some embodiments, the assigning module 440 may determine a congestion probability of each congested link in the congested area based on the historical congestion data. The assigning module 440 may determine the congestion probability of a congested link by dividing the number of times that the congested link was determined as a congested link at the one or more corresponding time points by the number of the corresponding time points. For example, the historical congestion data associated with a congested link corresponding to 8:00 am on a weekday (e.g., the current time) indicates that the number of times that the congested link was determined as a congested link corresponding to 8:00 am every weekday in the past 30 weekdays is equal to 27. The assigning module 440 may determine the congestion probability of the congested link as 90% (e.g., 27/30=90%). The assigning module 440 may determine whether a congested link is an abnormal congested link based on the congestion probability. The normal congested link refers to a congested link having normal congestion (e.g., with a probability higher than a threshold). The abnormal congested link refers to a congested link having abnormal congestion (e.g., with a probability lower than a threshold).

In some embodiments, the assigning module 440 may determine whether there is at least one abnormal congested link in the congested area. The assigning module 440 may determine the congested area as an abnormal congested area in response to a determination that there is at least one abnormal congested link in the congested area. The assigning module 440 may determine the congested area as a normal congested area in response to a determination that there is no abnormal congested link in the congested area.

In some embodiments, the assigning module 440 may determine whether the number of abnormal congested links in the congested area is equal to or higher than a threshold value (e.g., 2, 3, 4, 5, 10, etc.). The assigning module 440 may determine the congested area as an abnormal congested area in response to a determination that the number of abnormal congested links in the congested area is equal to or higher than the threshold value. The assigning module 440 may determine the congested area as a normal congested area in response to a determination that the number of abnormal congested links in the congested area is lower than the threshold value.

In some embodiments, the assigning module 440 may assign a designation of normal congested area or abnormal congested area to each of the one or more congested areas based on a result of the determination as to whether a congested area is a normal congested area or an abnormal area. For example, the assigning module 440 may assign a designation of normal congested area to a congested area in response to a determination that the congested area is a normal congested area. As another example, the assigning module 440 may assign a designation of abnormal congested area to a congested area in response to a determination that the congested area is an abnormal congested area.

The displaying module 450 may be configured to display congestion information associated with at least one of the one or more congested areas. In some embodiments, the displaying module 450 may display the congestion information associated with at least one abnormal congested area and/or the congestion information associated with at least one normal congested area.

In some embodiments, the congestion information associated with a congested area may include the first time point, the designation of normal congested area or abnormal congested area, a mark of normal congested link or abnormal congested link associated with at least one congested link in the congested area, an identification (ID) of at least one congested link in the congested area, a Point of Interest (POI) with respect to abnormal congestion, traffic change information, or the like, or any combination thereof. The designation of normal congested area or abnormal congested area may be presented by text, color, or the like, or any combination thereof. For example, the normal congested area may be identified by a green circle, and the abnormal congested area may be identified by a red circle. The mark of normal congested link or abnormal congested link may be presented by text, color, or the like, or any combination thereof. For example, the mark of normal congested link may be filled with a green color, and the mark of abnormal congested link may be filled with a red color. The POI with respect to abnormal congestion refers to a location where an event (e.g., a traffic accident) that may have caused the abnormal congestion to happen. The displaying module 450 may obtain the POI based on the road information (e.g., an accident happens in No. 3 Haidian Avenue) (e.g., as described elsewhere in this disclosure in connection with FIG. 5) sent by a user.

For a congested area corresponding to the first time point, the displaying module 450 may determine at least one similar congested area prior to the first time point. The similar prior congested area may be substantially similar to the congested area corresponding to the first time point. For example, the similar prior congested area and the congested area corresponding to the first time point may have a high percentage (e.g., more than 60%, 70%, 80% or 90%) of links in common. In some embodiments, the displaying module 450 may display the traffic change information associated with the congested area corresponding to the first time point based on the at least one similar prior congested area (e.g., as described elsewhere in this disclosure in connection with FIG. 9). The traffic change information may indicate when congestion (e.g., normal congestion and/or abnormal congestion) has started, when part of the prior congestion ended, where the congestion spreads, how long the congestion lasted or would likely last, or the like, or any combination thereof. The traffic change information may be displayed by text or by image (e.g., a smaller image at a corner of screen), or a combination thereof. Alternatively or additionally, the displaying module 450 may display the congested area corresponding to the first time point and the at least one similar congested area one by one in the time order to present a dynamic effect, which may show the traffic change information. Merely by way of example, the displaying module 450 may display the traffic change information associated with only abnormal congestion.

The modules in the processing engine 112 may be connected to or communicate with each other via a wired connection or a wireless connection. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof. Two or more of the modules may be combined as a single module, and any one of the modules may be divided into two or more units. For example, the clustering module 430 may be integrated in the assigning module 440 as a single module which may both determine one or more congested areas and determine whether a contested area is a normal congested area or an abnormal congested area for each congested area. As another example, the displaying module 450 may be divided into two units. The first unit may be configured to display congestion information. The second unit may be configured to determine traffic change information.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, the processing engine 112 may further include a storage module (not shown in FIG. 4). The storage module may be configured to store data generated during any process performed by any component of in the processing engine 112. As another example, each of components of the processing engine 112 may include a storage apparatus. Additionally or alternatively, the components of the computing device 120 may share a common storage apparatus.

Figure 5:
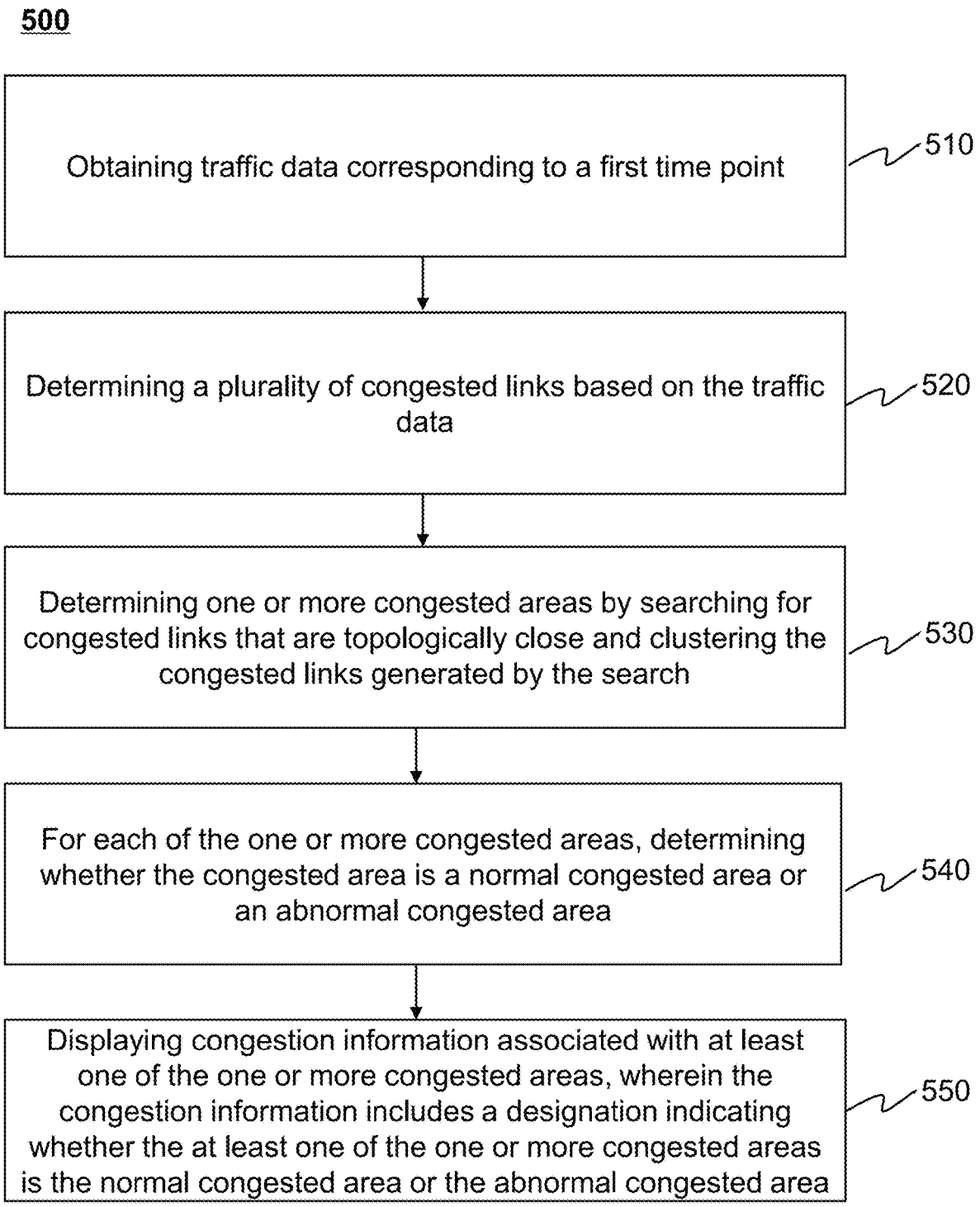
FIG. 5 is a flowchart illustrating an exemplary process for displaying congestion information associated with at least one congested area according to some embodiments of the present disclosure.

FIG. 5 is a flowchart illustrating an exemplary process for displaying congestion information associated with at least one congested area according to some embodiments of the present disclosure. In some embodiments, the process 500 may be implemented in the traffic congestion monitoring system 100 illustrated in FIG. 1. For example, the process 500 may be stored in a storage medium (e.g., the storage device 150, or the storage 220 of the processing engine 112) as a form of instructions, and invoked and/or executed by the server 110 (e.g., the processing engine 112 of the server 110, the processor 220 of the processing engine 112, or one or more modules in the processing engine 112 illustrated in FIG. 4). The operations of the illustrated process 500 presented below are intended to be illustrative. In some embodiments, the process 500 may be accomplished with one or more additional operations not described, and/or without one or more of the operations discussed. Additionally, the order in which the operations of the process 500 as illustrated in FIG. 5 and described below is not intended to be limiting.

In 510, the traffic data obtaining module 410 (or the processing engine 112, and/or the interface circuits 210-*a*) may obtain traffic data corresponding to a first time point (e.g., a current time). The traffic data may associate with a plurality of vehicles of users of the traffic congestion monitoring system 100 in a certain region (e.g., Beijing). The traffic data of a vehicle may include a speed of the vehicle, a location of the vehicle, an identification of the vehicle, or the like, or any combination thereof. The vehicle may include a horse, a carriage, a rickshaw (e.g., a wheelbarrow, a bike, a tricycle, etc.), an electromobile (e.g., an electric bike, an electric tricycle, etc.), a car (e.g., a taxi, a bus, a private car, etc.), a train, a subway, a vessel, an aircraft (e.g., an airplane, a helicopter, a space shuttle, a rocket, a hot-air balloon, etc.), or the like, or any combination thereof.

In some embodiments, a terminal (e.g., the user terminal 130) of a user may establish a communication (e.g., a wireless communication) with the processing engine 112, via an application installed in the terminal. In some embodiments, the application may relate to the traffic congestion monitoring system 100. The terminal may obtain the traffic data from and/or send the traffic data to the processing engine 112 through the application.

In some embodiments, the user terminal 130 of a user may determine the speed of a vehicle associated with the user by a speed sensor mounted in the user terminal 130. For example, when a driver is driving a vehicle, the driver's smart phone may determine the speed of the vehicle by a speed sensor mounted in the smart phone. In some embodiments, the user terminal 130 may determine the speed of the vehicle by periodically (e.g. every 1, 2, 5, 10, 20, or 30 seconds) monitoring the location of the vehicle, calculating a road distance between the locations, and calculating the speed by taking into consideration the time passed between various location changes.

In some embodiments, the user terminal 130 of the user may determine the location of the vehicle by a positioning technique in the user terminal 130. The position technique may include a GPS (global positioning system), a GLONASS (global navigation satellite system), a COMPASS (compass navigation system), a Galileo positioning system, a QZSS (quasi-zenith satellite system), a Wi-Fi (wireless fidelity positioning technology, various positioning and speed measuring systems that a vehicle has, or the like, or any combination thereof.

In some embodiments, the application installed in the user terminal 130 may direct the user terminal 130 to constantly send the real-time location of the vehicle and the real-time speed of the vehicle to the processing engine 112. Consequently, the processing engine 112 may receive the location of the vehicle and the speed of the vehicle in real-time or substantially real-time.

The identification of the vehicle may include a plate number, a vehicle identification number (VIN), or the like, or any combination thereof. In some embodiments, the user may input the identification of the vehicle through the interface of the application. In some embodiment, the user terminal 130 may automatically determine the identification of the vehicle. For example, a driver may register an account of the application when the driver first uses the application. The driver may input an identification of a vehicle and tie the vehicle to the application. When the user terminal 130 sends the speed and the location of the vehicle to the processing engine 112 through the application that is tied to the vehicle, the user terminal 130 may also send the identification of the vehicle to the processing engine 112. As another example, a passenger may request an order of a taxi service through the application. During the travel of the taxi service, the user terminal 130 of the passenger may determine the speed and the location of a vehicle of a driver that accepts the order and send the speed and the location of the vehicle along with the identification of the vehicle to the processing engine 112.

In some embodiments, the traffic data may further include road information. The road information may include traffic accident information, road maintenance information, event information (e.g., a concert), or the like, or any combination thereof. A user may input the road information through an interface of the application installed in the user terminal 130 and send the road information to the processing engine 112. For example, a user may input the road information that an accident happens in No. 3 Haidian Avenue and send the road information to the processing engine 112.

In 520, the congested link determination module 420 (or the processing engine 112, and/or the processing circuits 210-*b*) may determine a plurality of congested links based on the traffic data. A link refers to a segment of a road facing a particular direction in normal traffic. In some embodiments, a road network of a certain region (e.g., Beijing) may include a plurality of links. In some embodiments, for a link, the congested link determination module 420 may determine the area of the link. In certain embodiments, the area of a link refers to specific lateral area, e.g., 1200 square meters. In certain embodiments, the area of a link refers to vehicle accommodating area, e.g., 3 vehicle lanes, 300 meters long, not specific lateral area. The congested link determination module 420 may determine the total number of vehicles on the link based on the traffic data corresponding to the first time point. The congested link determination module 420 may determine a traffic density on the link based on the area of the link and the total number of vehicles on the link. The congested link determination module 420 may determine the number of vehicles of which the speed is lower than a first threshold (e.g., 5 km/h) based on the traffic data corresponding to the first time point. The congested link determination module 420 may determine whether the traffic density on the link is greater than a second threshold (e.g., 12 square meters per vehicle, or 5 meters per lane per vehicle) and whether the proportion of the number of vehicles of which the speed is lower than the first threshold in the total number of vehicles on the link is greater than a third threshold (e.g., 90%). The congested link determination module 420 may determine the link as a congested link in response to a determination that the traffic density on the link is greater than the second threshold and the proportion is greater than the third threshold.

In 530, the clustering module 430 may determine one or more congested areas by searching for congested links that are topologically close and clustering the congested links generated by the search. The congested area may include one or more roads, one or more intersections, or the like, or any combination thereof. For example, the congested area may include Zhongguancun Street, Beijing, and the intersection of Zhongguancun Street, Beijing and North Fourth Ring Road West, Beijing.

In some embodiments, to be considered topologically close, two congested links may have a topologic distance that is less than a fourth threshold. In some embodiments, the topologic distance between two links refers to the length of a route between the two links. Therefore, in certain embodiments, two links that are geographically close (e.g., two neighboring highway segments in reverse directions) may not be topologically close. In some embodiments, if there are more than one route between the two links, the clustering module 430 may select a route length that is shortest among the lengths of the more than one route as the topologic distance between the two links. In certain embodiments, the clustering module 430 may select a route length that corresponds to a route that takes the shortest time in normal traffic conditions as the topologic distance between the two links. In some embodiments, the clustering module 430 may determine the one or more congested areas based on a Density-Based Spatial Clustering of Applications with Noise (DBSCAN) algorithm and a Dijkstra algorithm (e.g., as described elsewhere in this disclosure in connection with FIG. 6).

In 540, for each of the one or more congested areas, the assigning module 440 (or the processing engine 112, and/or the processing circuits 210-*b*) may determine whether the congested area is a normal congested area or an abnormal congested area. Traffic congestion may include normal congestion and abnormal congestion. Normal congestion refers to congestions that are easy to predict and happen regularly. For example, a normal congestion may be caused by the increasing number of people and vehicles traveling within rush hours. Abnormal congestion refers to congestions that are hard to predict and do not happen regularly. For example, an abnormal congestion may be caused by an accidental event such as a traffic accident or vehicle breakdown. The normal congested area refers to a congested area having normal congestion. The abnormal congested area refers to a congested area having abnormal congestion.

In some embodiments, the assigning module 440 may determine whether the congested area is a normal congested area or an abnormal congested area for each of the one or more congested area based on historical congestion data associated with the plurality of congested links (e.g., as described elsewhere in this disclosure in connection with FIGS. 7 and 8). The historical congestion data associated with a congested link corresponding to the first time point may include the number of times that the congested link was determined as a congested link at one or more corresponding time points in a time period prior to the first time point. The one or more corresponding time points may correspond to the first time point in terms of a predetermined categorization (e.g. weekday or weekend). For example, the historical congestion data associated with a congested link corresponding to 8:00 am on a weekday (e.g., the current time) may include the number of times that the congested link was determined as a congested link corresponding to 8:00 am every weekday in a time period (e.g., the past 30 weekdays).

In some embodiments, the assigning module 440 may determine a congestion probability of each congested link in the congested area based on the historical congestion data. The assigning module 440 may determine the congestion probability of a congested link by dividing the number of times that the congested link was determined as a congested link at the one or more corresponding time points by the number of the corresponding time points. For example, the historical congestion data associated with a congested link corresponding to 8:00 am on a weekday (e.g., the current time) indicates that the number of times that the congested link was determined as a congested link corresponding to 8:00 am every weekday in the past 30 weekdays is equal to 27. The assigning module 440 may determine the congestion probability of the congested link as 90% (e.g., 27/30=90%). The assigning module 440 may determine whether a congested link is an abnormal congested link based on the congestion probability. The normal congested link refers to a congested link having normal congestion (e.g., with a probability higher than a threshold). The abnormal congested link refers to a congested link having abnormal congestion (e.g., with a probability lower than a threshold).

In some embodiments, the assigning module 440 may determine whether there is at least one abnormal congested link in the congested area. The assigning module 440 may determine the congested area as an abnormal congested area in response to a determination that there is at least one abnormal congested link in the congested area. The assigning module 440 may determine the congested area as a normal congested area in response to a determination that there is no abnormal congested link in the congested area.

In some embodiments, the assigning module 440 may determine whether the number of abnormal congested links in the congested area is equal to or higher than a threshold value (e.g., 2, 3, 4, 5, 10, etc.). The assigning module 440 may determine the congested area as an abnormal congested area in response to a determination that the number of abnormal congested links in the congested area is equal to or higher than the threshold value. The assigning module 440 may determine the congested area as a normal congested area in response to a determination that the number of abnormal congested links in the congested area is lower than the threshold value.

In some embodiments, the assigning module 440 may assign a designation of normal congested area or abnormal congested area to each of the one or more congested areas based on a result of the determination as to whether a congested area is a normal congested area or an abnormal area. For example, the assigning module 440 may assign a designation of normal congested area to a congested area in response to a determination that the congested area is a normal congested area. As another example, the assigning module 440 may assign a designation of abnormal congested area to a congested area in response to a determination that the congested area is an abnormal congested area.

In 550, the displaying module 450 (or the processing engine 112, and/or the processing circuits 210-*b*) may display congestion information associated with at least one of the one or more congested areas. In some embodiments, the displaying module 450 may display the congestion information associated with at least one abnormal congested area and/or the congestion information associated with at least one normal congested area.

In some embodiments, the congestion information associated with a congested area may include the first time point, the designation of normal congested area or abnormal congested area, a mark of normal congested link or abnormal congested link associated with at least one congested link in the congested area, an identification (ID) of at least one congested link in the congested area, a Point of Interest (POI) with respect to abnormal congestion, traffic change information, or the like, or any combination thereof. The designation of normal congested area or abnormal congested area may be presented by text, color, or the like, or any combination thereof. For example, the normal congested area may be identified by a green circle, and the abnormal congested area may be identified by a red circle. The mark of normal congested link or abnormal congested link may be presented by text, color, or the like, or any combination thereof. For example, the mark of normal congested link may be filled with a green color, and the mark of abnormal congested link may be filled with a red color. The POI with respect to abnormal congestion refers to a location where an event (e.g., a traffic accident) that may have caused the abnormal congestion to happen. The displaying module 450 may obtain the POI based on the road information (e.g., an accident happens in No. 3 Haidian Avenue) (e.g., as described elsewhere in this disclosure in connection with FIG. 5) sent by a user.

In some embodiments, the processing engine 112 may perform the process 500 at intervals (e.g., every 1, 2, 3, 4, 5 or 10 minutes). Fora congested area corresponding to the first time point, the displaying module 450 may determine at least one similar congested area prior to the first time point. For example, the processing engine 112 may perform the process 500 every two minutes. The displaying module 450 may determine a similar prior congested area corresponding to 8:00 am for a congested area corresponding to 8:02 am (e.g., the current time). The similar prior congested area may be substantially similar to the congested area corresponding to the first time point. For example, the similar prior congested area and the congested area corresponding to the first time point may have a high percentage (e.g., more than 60%, 70%, 80% or 90%) of links in common. In some embodiments, the displaying module 450 may display the traffic change information associated with the congested area corresponding to the first time point based on the at least one similar prior congested area (e.g., as described elsewhere in this disclosure in connection with FIG. 9). The traffic change information may indicate when congestion (e.g., normal congestion and/or abnormal congestion) has started, when part of the prior congestion ended, where the congestion spreads, how long the congestion lasted or would likely last, or the like, or any combination thereof. The traffic change information may be displayed by text or by image (e.g., a smaller image at a corner of screen), or a combination thereof. Alternatively or additionally, the displaying module 450 may display the congested area corresponding to the first time point and the at least one similar congested area one by one in the time order to present a dynamic effect, which may show the traffic change information. Merely by way of example, the displaying module 450 may display the traffic change information associated with only abnormal congestion.

Figure 6:
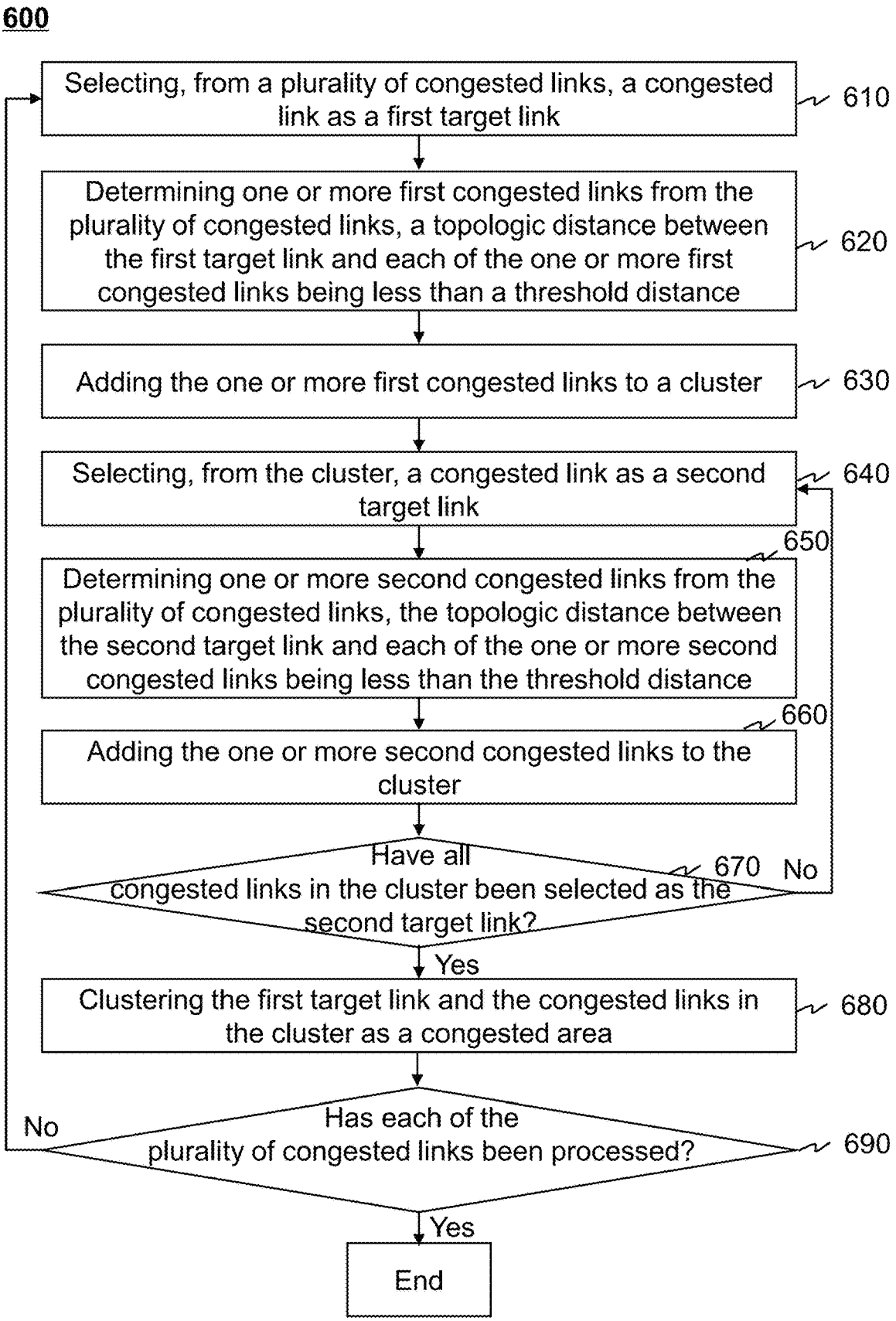
FIG. 6 is a flowchart illustrating an exemplary process for determining one or more congested areas based on a DBSCAN algorithm and a Dijkstra algorithm according to some embodiments of the present disclosure.

FIG. 6 is a flowchart illustrating an exemplary process for determining one or more congested areas based on a DBSCAN algorithm and a Dijkstra algorithm according to some embodiments of the present disclosure. In some embodiments, the process 600 may be implemented in the traffic congestion monitoring system 100 illustrated in FIG. 1. For example, the process 600 may be stored in a storage medium (e.g., the storage device 140, or the storage 220 of the processing engine 112) as a form of instructions, and invoked and/or executed by the server 110 (e.g., the processing engine 112 of the server 110, the processor 220 of the processing engine 112, or one or more modules in the processing engine 112 illustrated in FIG. 4). The operations of the illustrated process 600 presented below are intended to be illustrative. In some embodiments, the process 600 may be accomplished with one or more additional operations not described, and/or without one or more of the operations discussed. Additionally, the order in which the operations of the process 600 as illustrated in FIG. 6 and described below is not intended to be limiting. In some embodiments, step 530 illustrated in FIG. 5 may be performed according to the process 600.

The clustering module 420 may initiate a first iteration process for determining one or more congested areas based on the plurality of congested links. The first iteration process may include a plurality of iterations (e.g., steps 610-690).

In 610, the clustering module 430 (or the processing engine 112, and/or the processing circuits 210-*b*) may select, from a plurality of congested links, a congested link as a first target link.

In 620, the clustering module 430 (or the processing engine 112, and/or the processing circuits 210-*b*) may determine one or more first congested links from the plurality of congested links. In some embodiments, the clustering module 430 may select the one or more first congested links by how close these links are to the first target link in terms of topologic distance. For example, a topologic distance between the first target link and each of the one or more first congested links may be less than a threshold distance (e.g., 10 meters). The topologic distance between two links refers to the length of a route between the two links. In some embodiments, if there are more than one route between the two links, the clustering module 430 may select a route length that is shortest among the lengths of the more than one route as the topologic distance between the two links. In some embodiments, the clustering module 430 may select a route length that corresponds to a route that takes the shortest time to travel in normal traffic conditions as the topologic distance between the two links.

The threshold distance may be predetermined or adjustable. In some embodiments, the threshold distance at least partly determines the number of links to be processed associated with the first target link. In certain embodiments, the threshold distance may be adjusted to increase or reduce the number of the links to be processed associated with the first target link.

In 630, the clustering module 430 (or the processing engine 112, and/or the processing circuits 210-*b*) may add the one or more first congested links to a cluster.

In some embodiments, the clustering module 430 may initiate a second iteration process for determining a congested area corresponding to the first target link based on the cluster. The second iteration process may include a plurality of iterations (e.g., steps 640-670).

In 640, the clustering module 430 (or the processing engine 112, and/or the processing circuits 210-*b*) may select, from the cluster, a congested link as a second target link.

In 650, the clustering module 430 (or the processing engine 112, and/or the processing circuits 210-*b*) may determine one or more second congested links from the plurality of congested links. In some embodiments, the topologic distance between the second target link and each of the one or more second congested links may be less than the threshold distance.

In 660, the clustering module 430 (or the processing engine 112, and/or the processing circuits 210-*b*) may add the one or more second congested links to the cluster.

In 670, the clustering module 430 (or the processing engine 112, and/or the processing circuits 210-*b*) may determine whether all congested links in the cluster have been selected as the second target link. The process 600 may proceed to step 640 to initiate a new iteration of the second iteration process in response to a determination that at least one congested link in the cluster has not been selected as the second target link. The process 600 may proceed to step 680 in response to a determination that all congested links in the cluster have been selected as the second target link.

In 680, the clustering module 430 (or the processing engine 112, and/or the processing circuits 210-*b*) may cluster the first target link and the congested links in the cluster as a congested area.

In 690, the clustering module 430 (or the processing engine 112, and/or the processing circuits 210-*b*) may determine whether each of the plurality of congested links has been processed (e.g., whether each of the plurality of congested links has been determined as the first target link, the second target link, the first congested link, or the second congested link, or whether each of the plurality of congested links has been included in the congested area determined in each iteration that has been performed in the first iteration process). In some embodiments, the process 600 may proceed to step 610 to initiate a new iteration of the first iteration process in response to a determination that at least one of the plurality of congested links has not been processed. The clustering module 430 may terminate the first iteration process and output the congested area determined in each of the plurality of iterations in the first iteration process in response to a determination that each of the plurality of congested links has been processed.

FIG. 7 is a flowchart illustrating an exemplary process for determining an abnormal congested link according to some embodiments of the present disclosure. In some embodiments, the process 700 may be implemented in the traffic congestion monitoring system 100 illustrated in FIG. 1. For example, the process 700 may be stored in a storage medium (e.g., the storage device 140, or the storage 220 of the processing engine 112) as a form of instructions, and invoked and/or executed by the server 110 (e.g., the processing engine 112 of the server 110, the processor 220 of the processing engine 112, or one or more modules in the processing engine 112 illustrated in FIG. 4). The operations of the illustrated process 700 presented below are intended to be illustrative. In some embodiments, the process 700 may be accomplished with one or more additional operations not described, and/or without one or more of the operations discussed. Additionally, the order in which the operations of the process 700 as illustrated in FIG. 7 and described below is not intended to be limiting. In some embodiments, part of step 540 illustrated in FIG. 5 may be performed according to the process 700.

In some embodiments, for one congested link, the assigning module 440 (or the processing engine 112, and/or the processor 210) may perform the process 700 to determine whether the congested link is a normal congested link or an abnormal congested link. The assigning module 440 (or the processing engine 112, and/or the processor 210) may process a plurality of congested links one by one or simultaneously.

In 710, the assigning module 440 (or the processing engine 112, and/or the interface circuits 210-*a*) may obtain historical congestion data associated with a congested link from a storage medium (e.g., the storage device 140, or the storage 220 of the processing engine 112). The historical congestion data associated with a congested link corresponding to the first time point may include the number of times that the congested link was determined as a congested link at one or more corresponding time points in a time period prior to the first time point. In some embodiments, the one or more corresponding time points may correspond to the first time point in terms of a predetermined categorization (e.g. weekday or weekend). For example, the historical congestion data associated with a congested link corresponding to 8:00 am on a weekday (e.g., the current time) may include the number of times that the congested link was determined as a congested link corresponding to 8:00 am every weekday in the past 30 weekdays.

In 720, the assigning module 440 (or the processing engine 112, and/or the interface circuits 210-*a*) may determine a congestion probability of the congested link based on the historical congestion data. The assigning module 440 may determine the congestion probability by dividing the number of times that the congested link was determined as a congested link at the one or more corresponding time points by the number of the one or more corresponding time points. For example, the historical congestion data associated with the congested link corresponding to 8:00 am on a weekday (e.g., the current time) indicates that the number of times that the congested link was determined as a congested link corresponding to 8:00 am every weekday in the past 30 weekdays is equal to 27. The assigning module 440 may determine the congestion probability of the congested link as 90% (e.g., 27/30=90%).

In 730, the assigning module 440 (or the processing engine 112, and/or the interface circuits 210-*a*) may determine whether the congestion probability is greater than a threshold probability (e.g., 50%, 60%, 70%, 80%, or 90%). The process 700 may proceed to 740 to determine the congested link as a normal congested link in response to a determination that the congestion probability is greater than the threshold probability. The process 700 may proceed to 750 to determine the congested link as an abnormal congested link in response to a determination that the congestion probability is equal to or less than the threshold probability.

FIG. 8 is a flowchart illustrating an exemplary process for determining an abnormal congested area according to some embodiments of the present disclosure. In some embodiments, the process 800 may be implemented in the traffic congestion monitoring system 100 illustrated in FIG. 1. For example, the process 800 may be stored in a storage medium (e.g., the storage device 140, or the storage 220 of the processing engine 112) as a form of instructions, and invoked and/or executed by the server 110 (e.g., the processing engine 112 of the server 110, the processor 220 of the processing engine 112, or one or more modules in the processing engine 112 illustrated in FIG. 4). The operations of the illustrated process 800 presented below are intended to be illustrative. In some embodiments, the process 800 may be accomplished with one or more additional operations not described, and/or without one or more of the operations discussed. Additionally, the order in which the operations of the process 800 as illustrated in FIG. 8 and described below is not intended to be limiting. In some embodiments, part of step 540 illustrated in FIG. 5 may be performed according to the process 800. In some embodiments, the assigning module 440 (or the processing engine 112, and/or the processor 210) may perform the process 800 based on a determination result of the process 700. The determination result of the process 700 may indicate whether each of a plurality of congested links is a normal congested link or an abnormal congested link.

In some embodiments, for one congested area, the assigning module 440 (or the processing engine 112, and/or the processor 210) may perform the process 800 to determine whether the congested link is a normal congested area or an abnormal congested area. The assigning module 440 (or the processing engine 112, and/or the processor 210) may process a plurality of congested areas one by one or simultaneously.

In 810, the assigning module 440 (or the processing engine 112, and/or the interface circuits 210-*a*) may determine whether the number (also referred to as count) of abnormal congested links in the congested area is greater than a threshold number (e.g., 1, 2, 3, 4, 5, 10, etc.). The process 800 may proceed to 820 to determine the congested area as an abnormal congested area in response to a determination that the number of abnormal congested links in the congested area is greater than the threshold number. The process 800 may proceed to 830 to determine the congested area as a normal congested area in response to a determination that the number of abnormal congested links in the congested area is less than or equal to the threshold number.

Figure 9:
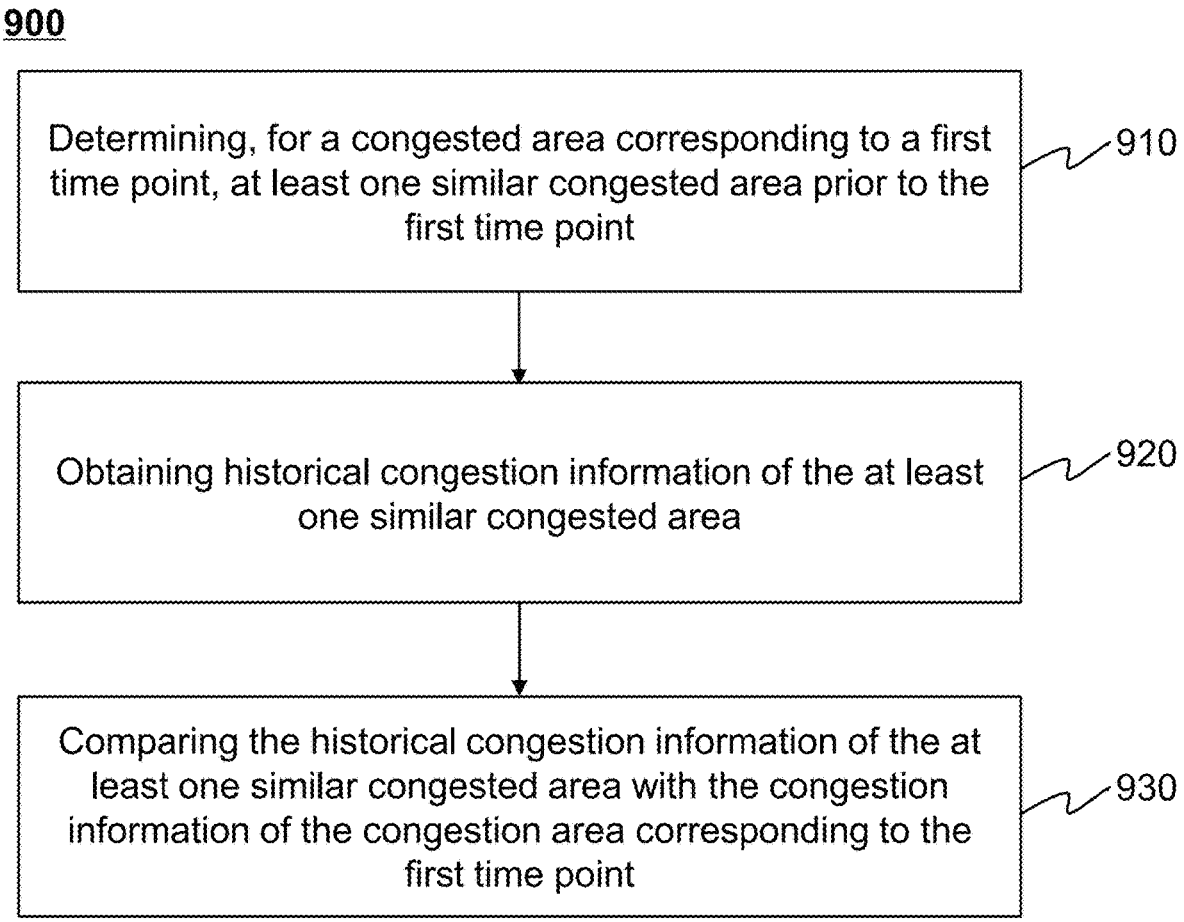
FIG. 9 is a flowchart illustrating an exemplary process for generating traffic change information according to some embodiments of the present disclosure.

FIG. 9 is a flowchart illustrating an exemplary process for generating traffic change information according to some embodiments of the present disclosure. In some embodiments, the process 900 may be implemented in the traffic congestion monitoring system 100 illustrated in FIG. 1. For example, the process 900 may be stored in a storage medium (e.g., the storage device 140, or the storage 220 of the processing engine 112) as a form of instructions, and invoked and/or executed by the server 110 (e.g., the processing engine 112 of the server 110, the processor 220 of the processing engine 112, or one or more modules in the processing engine 112 illustrated in FIG. 4). The operations of the illustrated process 900 presented below are intended to be illustrative. In some embodiments, the process 900 may be accomplished with one or more additional operations not described, and/or without one or more of the operations discussed. Additionally, the order in which the operations of the process 900 as illustrated in FIG. 9 and described below is not intended to be limiting. In some embodiments, step 550 illustrated in FIG. 5 may be performed according to the process 900.

In some embodiments, for one congested area corresponding to a first time point, the assigning module 440 (or the processing engine 112, and/or the processor 210) may perform the process 900 to determine at least one similar congested area prior to the first time point. In some embodiments, the assigning module 440 (or the processing engine 112, and/or the processor 210) may perform the process 900 for at least one normal congested area and/or at least one abnormal congested area one by one or simultaneously.

In 910, the displaying module 450 (or the processing engine 112, and/or the processing circuits 210-*a*) may determine, for at least one congested area corresponding to the first time point, at least one similar congested area prior to the first time point. For example, the processing engine 112 may perform the process 500 every two minutes. The displaying module 450 may determine a similar congested area corresponding to 8:00 am for a congested area corresponding to 8:02 am (e.g., the current time). The similar congested area may be substantially similar to the congested area corresponding to the first time point. For example, the similar congested area and the congested area corresponding to the first time point may have a high percentage (e.g., more than 60%, 70%, 80%, or 90%) of links in common.

Merely by way of example, the displaying module 450 may obtain first IDs of the congested links in the congested area corresponding to the first time point and second IDs of the congested links in at least one congested area prior to the first time point from a storage medium (e.g., the storage device 140, or the storage 220 of the processing engine 112). The displaying module 450 may compare the first IDs with the second IDs and determine a Jaccard index between the first IDs and the second IDs. The displaying module 450 may determine a congested area prior to the first time point as a similar congested area in response to a determination that the Jaccard index between the congested area prior to the first time point and the congested area corresponding to the first time point is greater than a threshold value.

In 920, the displaying module 450 (or the processing engine 112, and/or the interface circuits 210-*a*) may obtain historical congestion information of the at least one similar congested area. The historical congestion information of a similar congested area may include a time point prior to the first time point, a designation of normal congested area or abnormal congested area, a mark of normal congested link or abnormal congested link associated with at least one congested link in the similar congested area, an ID of at least one congested link in the similar congested area, a POI with respect to abnormal congestion, or the like, or any combination thereof.

In 930, the displaying module 450 (or the processing engine 112, and/or the interface circuits 210-*a*) may compare the historical congestion information of the at least one similar congested area with the congestion information of the congested area corresponding to the first time point. The traffic change information may indicate when congestion (e.g., normal congestion and/or abnormal congestion) has started, when part or all of the prior congestion ended, where the congestion spreads, how long the congestion lasted or would last, or the like, or any combination thereof.

For example, the displaying module 450 may compare the abnormal congested links in an abnormal congested area corresponding to the first time point with the abnormal congested links in at least one similar congested area to obtain a result indicating where the abnormal congestion spreads. As another example, the displaying module 450 may compare the first time point with at least one time point prior to the first time to obtain a result indicating when the abnormal congestion has started, when the abnormal congestion ended, or how long the abnormal congestion lasted.

The traffic change information may be displayed by text or image, or a combination thereof. Alternatively or additionally, the displaying module 450 may display the congested area corresponding to the first time point and the at least one similar congested area one by one in the time order to present a dynamic effect, which may show part or all of the traffic change information. Merely by way of example, the displaying module 450 may display the traffic change information associated with only abnormal congestion.

Figure 10:
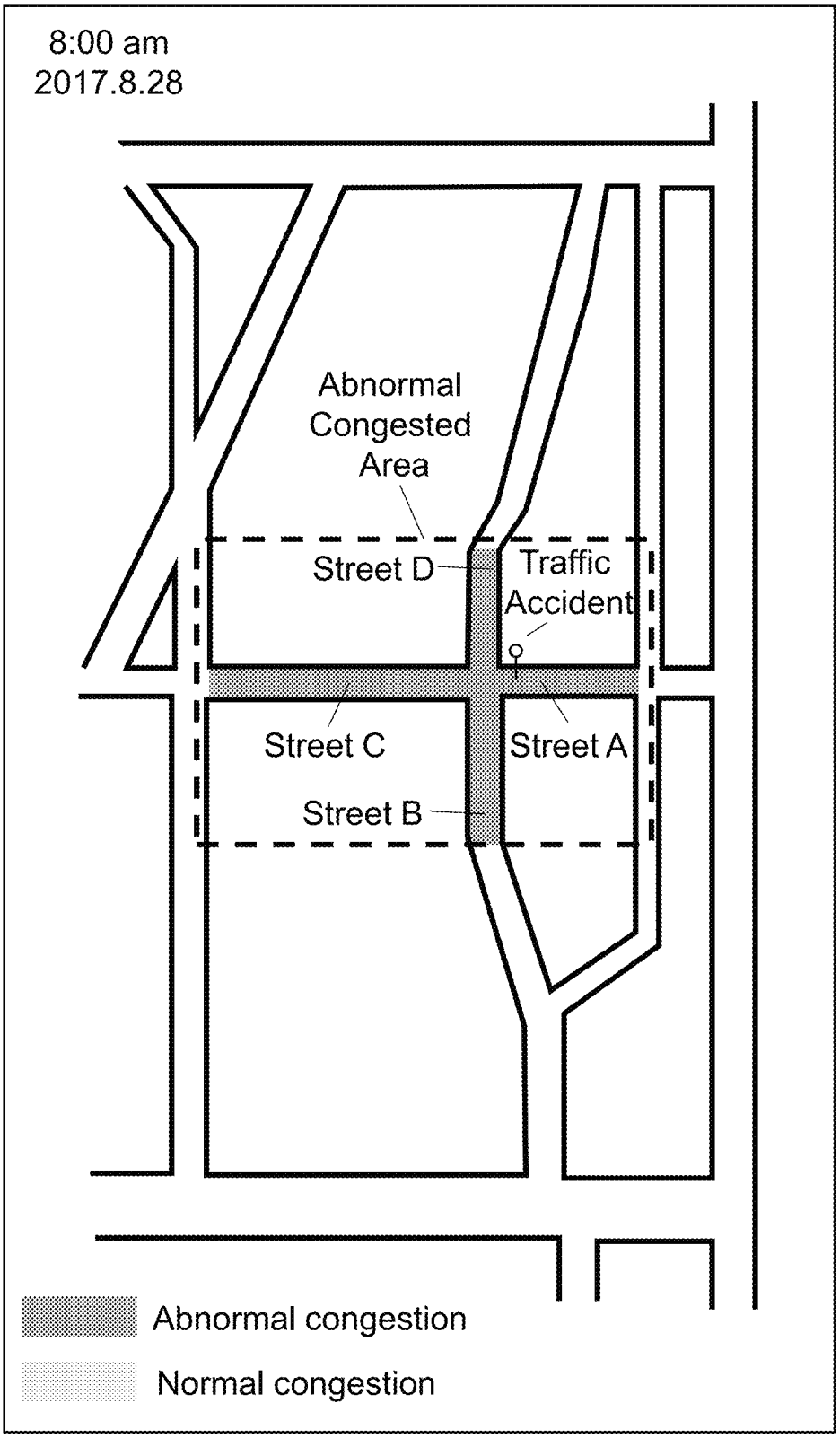
FIG. 10 is a schematic diagram for displaying exemplary congestion information associated with an abnormal congested area according to some embodiments of the present disclosure.

FIG. 10 is a schematic diagram for displaying exemplary congestion information associated with an abnormal congested area according to some embodiments of the present disclosure. As shown in FIG. 10, the displaying module 450 displays the first time point (e.g., 8:00 am, Aug. 28, 2017), the name (e.g., Street A, Street B, Street C, and Street D) of each road with abnormal congestion in the abnormal congested area, the designation of abnormal congested area (e.g., a dashed rectangle and the text of "abnormal congested area"), a mark of normal congestion (e.g., a lighter color), a mark of abnormal congestion (e.g., a darker color), and a POI of a traffic accident that causes the abnormal congestion.

Figure 11A:
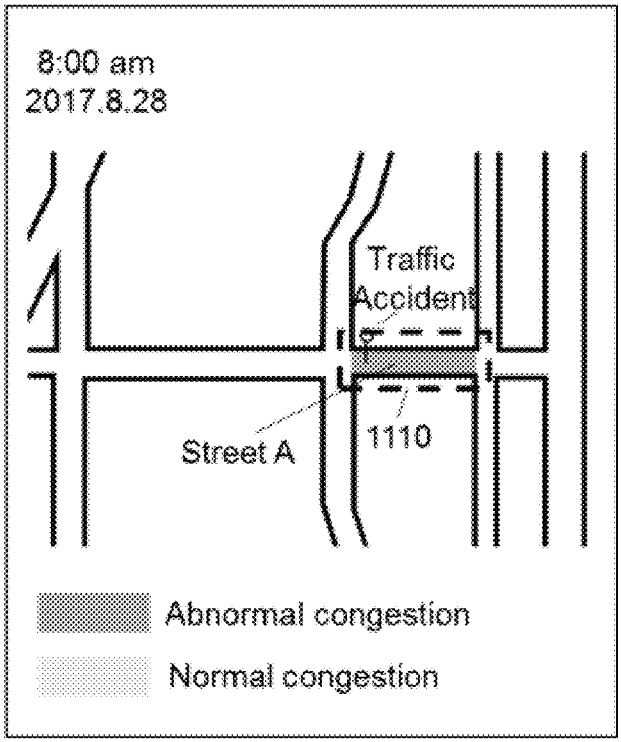
FIGS. 11A and 11B are schematic diagrams for displaying exemplary traffic change information associated with an abnormal congested area according to some embodiments of the present disclosure.
Figure 11B:
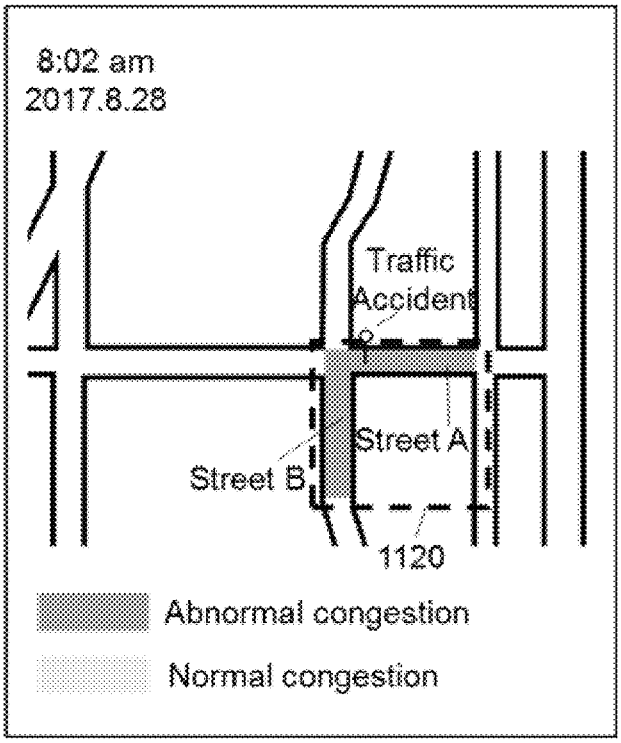

FIGS. 11A and 11B are schematic diagrams for displaying exemplary traffic change information associated with an abnormal congested area according to some embodiments of the present disclosure. As shown in FIGS. 11A and 11B, area 1120 is an abnormal congested area corresponding to 8:02 am (e.g., the current time). Area 1110 is an abnormal congested area corresponding to 8:00 am. Area 1110 includes abnormal congested Street A and area 1120 includes abnormal congested Street A and abnormal congested Street B. Area 1110 is a similar congested area of area 1120. Area 1110 and area 1120 may be displayed in the time order (e.g., area 1120 is displayed after area 1110), which indicates that the abnormal congestion caused by a traffic accident has spread from Street A to Street B in the time period from 8:00 am to 8:02 am.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

We claim:

1. A system for monitoring traffic congestion, comprising:

at least one storage device storing a set of instructions; and at least one processor configured to communicate with the storage device, wherein when executing the set of instructions, the at least one processor is configured to cause the system to:

obtain traffic data associated with speeds or locations of a plurality of vehicles at a first time point;

determine a plurality of congested links based on the traffic data;

determine one or more congested areas by searching for congested links that are topologically close and clustering the congested links generated by the search;

for each of the one or more congested areas, determine whether the congested area is a normal congested area or an abnormal congested area; and display congestion information associated with at least one of the one or more congested areas, wherein the congestion information includes a designation indicating whether the at least one of the one or more congested areas is the normal congested area or the abnormal congested area.

2. The system of claim 1, wherein determining of the one or more congested area is conducted with:

a Density-Based Spatial Clustering of Applications with Noise (DBSCAN) algorithm and a Dijkstra algorithm.

3. The system of claim 1, wherein to determine the one or more congested area, the at least one processor is configured to cause the system to:

initiate a first iteration process for determining the one or more congested areas, the first iteration process including a plurality of iterations, and each iteration in the first iteration process including:

selecting, from the plurality of congested links, a congested link as a first target link;

determining, from the plurality of congested links, one or more first congested links, a topologic distance between the first target link and each of the one or more first congested links being less than a threshold distance;

adding the one or more first congested links to a cluster; and determining a congested area associated with the first target link based on the cluster; and determine the one or more congested areas based on the congested area determined in each iteration in the first iteration process.

4. The system of claim 3, wherein at least one of the plurality of iterations in the first iteration process further includes:

determining whether each of the plurality of congested links is included in the congested area determined in each iteration in the first iteration process;

terminating the first iteration process in response to a determination that each of the plurality of congested links is included in the congested area determined in each iteration in the first iteration process; and initiating a new iteration of the first iteration process in response to a determination that at least one of the plurality of congested links is not included in the congested area determined in each iteration in the first iteration process.

5. The system of claim 3, wherein to determine the congested area associated with the first target link based on the cluster, the at least one processor is configured to cause the system to:

initiate a second iteration process for determining the congested area associated with the first target link based on the cluster, the second iteration process including a plurality of iterations, each iteration in the second iteration process including:

selecting, from the cluster, a congested link as a second target link;

determining, from the plurality of congested links, one or more second congested links, the topology distance between the second target link and each of the one or more second congested links being less than the threshold distance; and adding the one or more second congested links to the cluster; and cluster the first target link and the congested links in the cluster as the congested area associated with the first target link.

6. The system of claim 5, wherein at least one of the plurality of iterations in the second iteration process further includes:

determining whether all congested links in the cluster have been selected as the second target link;

terminating the second iteration process in response to a determination that all congested links in the cluster have been selected as the second target link; and initiating a new iteration of the second iteration process in response to a determination that at least one congested link in the cluster has not been selected as the second target link.

7. The system of claim 1, wherein to determine whether the congested area is the normal congested area or the abnormal congested area, the at least one processor is configured to cause the system to:

for each of the plurality of congested links, obtain historical congestion data associated with the congested link;

determine a congestion probability of the congested link based on the historical congestion data;

determine whether the congestion probability is greater than a threshold probability; and determine the congested link as an abnormal congested link in response to a determination that the congestion probability is less than or equal to the threshold probability;

for each of the one or more congested areas, determine whether a count of abnormal congested links in the congested area is greater than a threshold number; and determine the congested area as the abnormal congested area in response to a determination that the count of abnormal congested links in the congested area is greater than the threshold number; or determine the congested area as the normal congested area in response to a determination the count of abnormal congested links in the congested area is less than or equal to the threshold number.

8. The system of claim 1, wherein the congestion information further comprises traffic change information that is generated by:

obtaining historical congestion information of at least one similarly congested area prior to the first time point, wherein the at least one similarly congested area is substantially similar to the at least one congested area of which the congestion information is being displayed; and comparing the historical congestion information of the at least one similarly congested area with the congestion information of the at least one congested area of which the congestion information is being displayed.

9. A method for monitoring traffic congestion implemented on a computing device having one or more processors and one or more storage media, the method comprising:

obtaining traffic data associated with speeds or locations of a plurality of vehicles at a first time point;

determining a plurality of congested links based on the traffic data;

determining one or more congested areas by searching for congested links that are topologically close and clustering the congested links generated by the search;

for each of the one or more congested areas, determining whether the congested area is a normal congested area or an abnormal congested area; and displaying congestion information associated with at least one of the one or more congested areas, wherein the congestion information includes a designation indicating whether the at least one of the one or more congested areas is the normal congested area or the abnormal congested area.

10. The method of claim 9, wherein the determining of the one or more congested area is conducted with:

a Density-Based Spatial Clustering of Applications with Noise (DBSCAN) algorithm and a Dijkstra algorithm.

11. The method of claim 9, wherein the determining of the one or more congested area comprises:

initiating a first iteration process for determining the one or more congested areas, the first iteration process including a plurality of iterations, and each iteration in the first iteration process including:

selecting, from the plurality of congested links, a congested link as a first target link;

determining, from the plurality of congested links, one or more first congested links, a topologic distance between the first target link and each of the one or more first congested links being less than a threshold distance;

adding the one or more first congested links to a cluster; and determining a congested area associated with the first target link based on the cluster; and determining the one or more congested areas based on the congested area determined in each iteration in the first iteration process.

12. The method of claim 11, wherein at least one of the plurality of iterations in the first iteration process further includes:

determining whether each of the plurality of congested links is included in the congested area determined in each iteration in the first iteration process;

terminating the first iteration process in response to a determination that each of the plurality of congested links is included in the congested area determined in each iteration in the first iteration process; and initiating a new iteration of the first iteration process in response to a determination that at least one of the plurality of congested links is not included in the congested area determined in each iteration in the first iteration process.

13. The method of claim 11, wherein the determining of the congested area associated with the first target link based on the cluster comprises:

initiating a second iteration process for determining the congested area associated with the first target link based on cluster, the second iteration process including a plurality of iterations, each iteration in the second iteration process including:

selecting, from the cluster, a congested link as a second target link;

determining, from the plurality of congested links, one or more second congested links, the topology distance between the second target link and each of the one or more second congested links being less than the threshold distance; and adding the one or more second congested links to the cluster; and clustering the first target link and the congested links in the cluster as the congested area associated with the first target link.

14. The method of claim 13, wherein at least one of the plurality of iterations in the second iteration process further includes:

determining whether all congested links in the cluster have been selected as the second target link; and terminating the second iteration process in response to a determination that all congested links in the cluster have been selected as the second target link; and initiating a new iteration of the second iteration process in response to a determination that at least one congested link in the cluster has not been selected as the second target link.

15. The method of claim 9, wherein the determining whether the congested area is the normal congested area or the abnormal congested area comprises:

for each of the plurality of congested links, obtaining historical congestion data associated with the congested link;

determining a congestion probability of the congested link based on the historical congestion data;

determining whether the congestion probability is greater than a threshold probability; and determining the congested link as an abnormal congested link in response to a determination that the congestion probability is less than or equal to the threshold probability;

for each of the one or more congested areas, determining whether a count of abnormal congested links in the congested area is greater than a threshold number; and determining the congested area as the abnormal congested area in response to a determination that the count of abnormal congested links in the congested area is greater than the threshold number; or determining the congested area as the normal congested area in response to a determination the count of abnormal congested links in the congested area is less than or equal to the threshold number.

16. The method of claim 9, wherein the congestion information further comprises traffic change information that is generated by:

obtaining historical congestion information of at least one similarly congested area prior to the first time point, wherein the at least one similarly congested area is substantially similar to the at least one congested area of which the congestion information is being displayed; and comparing the historical congestion information of the at least one similarly congested area with the congestion information of the at least one congested area of which the congestion information is being displayed.

17. A non-transitory computer readable medium, comprising at least one set of instructions, wherein when executed by one or more processors of a computing device, the at least one set of instructions causes the computing device to perform a method, the method comprising:

obtaining traffic data associated with speeds or locations of a plurality of vehicles at a first time point;

determining a plurality of congested links based on the traffic data;

determining one or more congested areas by searching for congested links that are topologically close and clustering the congested links generated by the search;

for each of the one or more congested areas, determining whether the congested area is a normal congested area or an abnormal congested area; and displaying congestion information associated with at least one of the one or more congested areas, wherein the congestion information includes a designation indicating whether the at least one of the one or more congested areas is the normal congested area or the abnormal congested area.

18. The non-transitory computer readable medium of claim 17, wherein the determining of the one or more congested area is conducted with:

a Density-Based Spatial Clustering of Applications with Noise (DBSCAN) algorithm and a Dijkstra algorithm.

19. The non-transitory computer readable medium of claim 17, wherein the determining of the one or more congested area comprises:

initiating a first iteration process for determining the one or more congested areas, the first iteration process including a plurality of iterations, and each iteration in the first iteration process including:

selecting, from the plurality of congested links, a congested link as a first target link;

determining, from the plurality of congested links, one or more first congested links, a topologic distance between the first target link and each of the one or more first congested links being less than a threshold distance;

adding the one or more first congested links to a cluster; and determining a congested area associated with the first target link based on the cluster; and determining the one or more congested areas based on the congested area determined in each iteration in the first iteration process.

20. The non-transitory computer readable medium of claim 19, wherein the determining of the congested area associated with the first target link based on the cluster comprises:

initiating a second iteration process for determining the congested area associated with the first target link based on cluster, the second iteration process including a plurality of iterations, each iteration in the second iteration process including:

selecting, from the cluster, a congested link as a second target link;

determining, from the plurality of congested links, one or more second congested links, the topology distance between the second target link and each of the one or more second congested links being less than the threshold distance; and adding the one or more second congested links to the cluster; and clustering the first target link and the congested links in the cluster as the congested area associated with the first target link.

* * * * *